US005832636A

United States Patent [19]

Lyden et al.

[11] Patent Number: 5,832,636

[45] Date of Patent: Nov. 10, 1998

[54] ARTICLE OF FOOTWEAR HAVING NON-CLOGGING SOLE

[75] Inventors: Robert M. Lyden, Aloha, Oreg.; Souheng Wu, Wilmington, Del.

[73] Assignees: Nike, Inc.; Nike International Ltd., both of Beaverton, Oreg.

[21] Appl. No.: 709,537

[22] Filed: Sep. 6, 1996

[51] Int. Cl.[6] ..... A43B 11/00; A43B 5/02

[52] U.S. Cl. ..... 36/59 R; 36/134; 36/127; 36/67 R

[58] Field of Search ..... 36/134, 67 D, 36/67 R, 127, 59 R, 67 A, 59 C

[56] References Cited

U.S. PATENT DOCUMENTS

| | | |
|---|---|---|
| Re. 33,066 | 9/1989 | Stubblefield . |
| 1,568,064 | 1/1926 | Goldman . |
| 1,768,426 | 6/1930 | Stelzer . |
| 2,258,734 | 10/1941 | Brady . |
| 2,303,744 | 12/1942 | Jacobs . |
| 2,844,833 | 7/1958 | Odermatt . |
| 3,341,952 | 9/1967 | Dassler . |
| 3,410,005 | 11/1968 | Szerenyl . |
| 3,552,040 | 1/1987 | Welco et al. . |
| 3,553,858 | 1/1971 | Austin . |
| 3,672,077 | 6/1972 | Coles . |
| 3,760,514 | 9/1973 | Egtvedt . |
| 3,816,945 | 6/1974 | Egtvedt . |
| 3,928,881 | 12/1975 | Bente . |
| 3,993,371 | 11/1976 | Orndorff, Jr. . |
| 4,085,526 | 4/1978 | Hemmer . |
| 4,107,858 | 8/1978 | Bowerman . |
| 4,130,947 | 12/1978 | Denu . |

(List continued on next page.)

FOREIGN PATENT DOCUMENTS

| | | |
|---|---|---|
| 1005909 | 4/1952 | France . |
| 24 58 576 | 12/1974 | Germany . |
| 25 42 116 | 3/1977 | Germany . |
| 34 23 363A1 | 1/1986 | Germany . |
| 4138941 | 6/1993 | Germany ..... 36/134 |
| 2 256784 | 12/1992 | United Kingdom . |
| 2 257616 | 1/1993 | United Kingdom . |

OTHER PUBLICATIONS

Physical Constants of Fluoropolymers, Carleton A. Sperati, Ohio University and E.I DuPont de Nemours & Co., Inc. Polumer Products Department, Wilmington, Deleware, V. 35–36.

Surface and Interfacial Tensions of Polymers, Oligomers, Plasticizers, and Organic Pigments, Souheng Wu, E.I. de Pont de Nemours & Company, Wilmington, Delaware, V.1/411–434.

Polymer Handbook, J. Brandrup and E.H. Immergut, 3rd Ed., John Wiley & Sons, New York, 1989.

(List continued on next page.)

*Primary Examiner*—M. D. Patterson
*Attorney, Agent, or Firm*—Banner & Witcoff, Ltd.

[57] ABSTRACT

The present invention provides an article of footwear having an upper and a non-clogging sole attached to the upper. The sole includes a generally planar ground engaging surface and at least one traction member or cleat projecting from the generally planar ground engaging surface. The traction member or cleat is attached with a base surface adjacent the generally planar ground engaging surface, side surfaces projecting downwards, and a tip attached at a bottom end of the traction member. At least a portion of the base surface and the side surfaces of the traction member or cleat and at least a portion of the ground engaging surface of the sole includes an adhesion prevention material having both a low coefficient of friction and a low wettability with respect to water in a preferred embodiment. However, the tip of the traction member remains substantially free of the adhesion prevention material. The adhesion prevention material has a coefficient of friction of less than 0.4, preferably between 0.1 and 0.3, and the low wettability of the material is preferably characterized such that the average of the advancing and receding contact angles of a drop of pure distilled water on said adhesion prevention material (herein called the wettability index) is equal to or greater than about 90 degrees.

34 Claims, 14 Drawing Sheets

U.S. PATENT DOCUMENTS

| | | | |
|---|---|---|---|
| 4,160,331 | 7/1979 | Bell . | |
| 4,178,702 | 12/1979 | Mayer . | |
| 4,194,310 | 3/1980 | Bowerman . | |
| 4,233,526 | 11/1980 | Kurogi et al. . | |
| 4,240,215 | 12/1980 | Broussard | 36/127 |
| 4,266,349 | 5/1981 | Schmohl . | |
| 4,298,038 | 11/1981 | Epple . | |
| 4,318,232 | 3/1982 | Ching . | |
| 4,327,503 | 5/1982 | Johnson . | |
| 4,344,999 | 8/1982 | Gohlke . | |
| 4,348,003 | 9/1982 | Beneteau . | |
| 4,366,632 | 1/1983 | Bente . | |
| 4,392,312 | 7/1983 | Crowley et al. . | |
| 4,393,604 | 7/1983 | Crowley . | |
| 4,398,357 | 8/1983 | Batra . | |
| 4,414,763 | 11/1983 | Bente . | |
| 4,445,289 | 5/1984 | Beneteau . | |
| 4,454,662 | 6/1984 | Stubblefield . | |
| 4,470,207 | 9/1984 | Bente . | |
| 4,494,320 | 1/1985 | Davis . | |
| 4,559,724 | 12/1985 | Norton . | |
| 4,561,197 | 12/1985 | Misevich . | |
| 4,562,651 | 1/1986 | Frederick et al. . | |
| 4,596,839 | 6/1986 | Peters . | |
| 4,599,810 | 7/1986 | Sacre . | |
| 4,633,600 | 1/1987 | Dassler et al. . | |
| 4,644,672 | 2/1987 | Dassler et al. . | |
| 4,648,187 | 3/1987 | Dassler et al. . | |
| 4,667,425 | 5/1987 | Effler et al. . | |
| 4,698,924 | 10/1987 | Greiner et al. . | |
| 4,712,318 | 12/1987 | Greiner et al. | 36/134 |
| 4,809,447 | 3/1989 | Pacanowsky et al. . | |
| 4,833,796 | 5/1989 | Flemming . | |
| 4,897,936 | 2/1990 | Fuerst . | |
| 4,899,485 | 2/1990 | Bleimhofer et al. . | |
| 4,962,136 | 10/1990 | Peters . | |
| 5,036,606 | 8/1991 | Erich et al. . | |
| 5,065,534 | 11/1991 | Collins . | |
| 5,077,916 | 1/1992 | Beneteau . | |
| 5,243,774 | 9/1993 | Mattiuzzo . | |
| 5,243,775 | 9/1993 | Swain | 36/134 |
| 5,286,279 | 2/1994 | Wu . | |
| 5,313,718 | 5/1994 | McMahon et al. . | |
| 5,461,801 | 10/1995 | Anderton | 36/134 |

OTHER PUBLICATIONS

Studies in Inorganic Chemistry 8: Graphite Fluorides, Nobuatsu Watanabe et al., Elsevier Science Publishing Company, Inc., New York, 1988, pp. 5, 99–101, 227–231.

Physical Characteristics:Alphaflex™ Additives, Alphaflex Industries, Inc., Indianapolis, IN.

Fluon: The Processing of PTFE Coagulated Dispersion Powders, ICI Fluoropolymers, Technical Service Note F3/4/5, 4th Ed., 1989.

Fluon: The Extrusion of PTFE Granular Powders, ICI Fluoropolymers, Technical Service Note F2, 6th Ed., 1989.

Zonyl Fluorosurfactants, Dupont Speciality Chemicals, Technical Bulletin H–49731, Aug. 1993.

Zonyl®, Fluorochemical Intermediates, Dupont Speciality Chemicals, Technical Bulletin H–49730–1, Jan. 1994.

An Overview of Fluorocarbon Elastomers, Al Stoskopf, Al Stoskopf, 3M, Tlargi Technical Conference, May 18, 1994.

Fluon: The Moulding of PTFE Granular Powders, ICI Fluoropolymers, Technical Service Note F1, 6th Ed., 1989.

Fluon: Polytetrafluoroethylene, ICI Advanced Materials, Reprinted from Encyclopedia of Chemical Technology, vol. 9, 1966.

The Processing of PTFE Coagulated Dispersion Powders, ICI Americas Inc., Technical Bulletin 805–3/86/2500.

Fluon: Colouring of Polytetrafluorethylene, ICI Advanced Materials, Technical Service Note F11, 6th Ed.

Fluoropolymers: Isostatic Compaction of PTFE Powders, ICI Fluoropolymers, Technical Service Note F14, 3rd Ed., 1993.

Fluoropolymers: Physical Properties of 'Fluon' Unfilled and 'Fluorocomp' Filled PTFE, ICI Fluoropolymers, Technical Service Note F12/13, 2nd Ed., 1993.

Polytetrafluoroethylene, S.V. Gangal, E.I. de Pont de Nemours & Co., Inc., Reprinted from Kirk–Othmer: Encyclopedia of Chemical Technology, vol. 11, 3rd Ed., pp. 1–24, 1980.

Teflon®/Tefzel®, Product Information, Brochure No. E–96678–2, Feb. 1993.

Flexibility in the Face of Change: High Performance Fluoroelastomers, 3M, Product Brochure, St. Paul, MN, Oct. 1993.

Aflas™, TFE Elastomer, 3M Technical Information, St. Paul, MN, Apr. 1994.

High Performance Fluoroelastomers: Product Comparison Guide, 3M, St. Paul, MN, Oct. 1994.

New Age Fluoroelastomers, 3M Industrial Chemical Products Division, St. Paul, MN, Aug. 1989.

Teflon® Coated Fabrics From Fluorglas, Allied Signal Advanced Materials, Dupont, Dec. 1993 Rev.

Teflon® Coated Belts From Fluorglas, Allied Signal, Dupont, Jan. 1989, Orig.

Teflon® Shapes From Fluorglas, Allied Signal, Dupont, May 1989, Orig.

Pressure Sensitive Adhesive Tapes From Fluorglas, Allied Signal, Dupont, Apr. 1989, Orig.

PTFE Films, Pressure Sensitive Tapes, Yarns & Fabrics, Allied Signal Advanced Materials, Fluorglas Products, Hoosick Falls, NY, Sep. 1993.

Fluorglas Pressive Sensitive Adhesive Tapes, Allied Signal Advanced Materials, Fluorglas Product, Hoosick Falls, NY, Nov. 1993.

Adidas Shoes and Accessories '84, Catalog Extract, p. 33.

Nike Catalog, Field Star Extract 3620, Nike, Inc., Sep. 1982.

Reebok Spring 1994, Reebok International Ltd., Stoughton, MA, Catalog Extract, pp. 5–6.

Adidas Shoes and Accessories Fall '94, Catalog Extract, pp. 4–9.

Nike Catalog, Tiempo M Extract 3413, Nike, Inc., Oct. 1983.

WATER DROP 130 ON
POLYTETRAFLUOROETHYLENE PTFE 131,
CONTACT ANGLE θ=109°

WATER DROP 130 ON TEFZEL® ETFE 132,
CONTACT ANGLE θ= 96°

WATER DROP 130 ON NYLON 133,
CONTACT ANGLE θ = 80°

WATER DROP 130 ON STYRENE-
BUTADIENE RUBBER 134,
CONTACT ANGLE θ = 63°

ARTICLE OF FOOTWEAR HAVING NON-CLOGGING SOLE

FIELD OF THE INVENTION

The present invention relates to an article of footwear having cleats or traction members, and more particularly, to the use of an adhesion prevention material having both a low coefficient of friction and a low wettability about at least the base and sides of the cleats or traction members, and in a preferred embodiment, also on at least a portion of the ground engaging surface or outsole of the article of footwear.

BACKGROUND OF THE INVENTION

Inversion sprains to the ankle and knee injuries induced by instability or foot fixation are the most common serious injuries incurred by football and soccer players, as discussed in "Sports Injuries and Footwear" and "Lateral Ankle Sprains," *Nike Sport Research Review*, November/December 1988, and July/August 1989, respectively. As noted therein, changing from fewer and longer cleats to more numerous and shorter cleats, e.g., changing from seven cleats having a length of three-quarters of an inch to fourteen cleats having a length of three eighths of an inch, can sometimes dramatically decrease the number of injuries that athletes receive. Moreover, the use of athletic footwear having more numerous cleats of a reduced height is generally less destructive to athletic fields with a natural surface because the field condition is not as quickly degraded, thereby also avoiding further hazard.

However, a practical problem arises when shorter and more numerous cleats or lugs are introduced on the ground engaging surface of an article of footwear intended for athletic use on natural surfaces. Generally, it is found in extremely wet or muddy conditions that shorter and more numerous cleats or lugs become clogged more quickly in comparison to longer and less numerous cleats or lugs. Accordingly, the additional traction initially afforded by an article of footwear having numerous short cleats can degrade in a matter of minutes under certain conditions.

Spraying silicone, or a like non-stick liquid coating upon the cleated outsole can offer temporary relief to clogging, and can provide a somewhat extended service life, e.g., perhaps as much as ten or twenty minutes. After a short time, however, the thin coating is removed due to contact with the natural playing surface and the traction afforded by the article of footwear diminishes rapidly. It is therefore desirable to introduce a permanent non-stick surface to the outsole or ground engaging surface of an athletic shoe.

However, when the simple solution of coating a substantial portion, or an entire sole, of an athletic shoe with a non-stick material such as Teflon® PTFE (i.e., polytetrafluoroethylene) is attempted, a further problem can be encountered. That is, the sole of the shoe can be made so slick that it makes walking off of the field on firm man-made surfaces, e.g., cement, asphalt, or indoor tile surfaces difficult and possibly hazardous. It is therefore advantageous to utilize a non-stick material in those areas where clogging is most probable to occur, e.g., in the area about the base and sides of the cleats or traction members, and in particular, in those areas characterized by sharp curvatures, but to retain at least in the tip of the cleat or traction member a material that will afford the wearer adequate traction and safety on and off the field.

An object of the present invention is the making of an athletic shoe suitable for use on natural surfaces, e.g., grass or earthen athletic fields, having reduced cleat and heel height, thereby enhancing stability by positioning the wearer's foot closer to the ground and reducing the likelihood for injuries, such as inversion sprains of the ankle. The presence of hard ground due to extreme weather conditions, e.g., exceptionally hot and dry weather, or alternately, extremely cold weather, can render the practical effect of cleat height in elevating a wearer's foot above the ground surface more pronounced when substantial penetration of the cleats into the natural surface is not possible. In such circumstances, it can be readily understood that the combined effects of reduced cleat penetration and traction, and elevated heel height can further increase the likelihood for possible injury.

A further object of the present invention is an athletic shoe suitable for use on natural surfaces having reduced cleat height, thereby enhancing stability by positioning the wearer's foot closer to the ground while reducing the likelihood for possible injury to the knee, or other portions of a wearer's anatomy that could be induced by foot fixation.

A further object of the present invention is to improve the overall performance capability, and in particular, the cutting and lateral movement performance capability of an article of footwear. Provided that adequate traction is afforded by the ground engaging surface of an article of footwear, reductions in the elevation of a wearer's foot relative to the ground surface is generally conducive to improved overall performance capability, and in particular, the wearer's ability to execute cutting and lateral movements.

A further object of the present invention is to enhance comfort, improve cushioning effects, and reduce the possibility of injury by reducing the high local plantar pressures placed upon a wearer's foot which are typically associated with the use of relatively few long cleats on the ground engaging surface of an article of footwear.

A further object of the present invention is to provide a non-clogging outsole or ground engaging surface on an article of footwear for enhancing traction.

A further object of the present invention is to provide a non-clogging ground engaging surface for preventing the build-up of foreign matter, e.g., grass or soil, which must subsequently be removed both in order to restore a desired level of traction quality, and to prevent soiling of clothes and indoor environments.

A further object of the present invention is to provide an article of footwear having reduced cleat height and a substantially non-stick ground engaging surface for lessening wear and damage to natural playing surfaces.

A further object of the present invention is to provide an article of footwear having cleats or traction members and a substantially non-stick outsole or ground engaging surface that permits relative safety for use by a wearer even when walking on relatively flat and smooth man-made support surfaces such as asphalt, cement, or tile.

SUMMARY OF THE INVENTION

The present invention provides an article of footwear having an upper and a non-clogging sole attached to the upper. The sole includes a generally planar ground engaging surface and at least one traction member or cleat projecting from the generally planar ground engaging surface. The traction member or cleat has a base surface which is adjacent to the generally planar ground engaging surface and side surfaces, and has a tip surface at the more distal end of the traction member.

In a preferred embodiment, at least a portion of the base surface and the side surfaces of the traction member or cleat and at least a portion of the ground engaging surface of the sole include an adhesion prevention material having both a low coefficient of friction and a low wettability with respect to water. In an alternate preferred embodiment, a portion of the ground engaging surface of the sole including the area adjacent the base of the cleat or lug includes an adhesion prevention material. In a further alternate preferred embodiment, at least the base and sides of the cleat or lug includes an adhesion prevention material. However, in all preferred embodiments, the tip of the traction member remains substantially free of the adhesion prevention material. The adhesion prevention material has a coefficient of friction of less than 0.4, preferably between 0.1 and 0.3, and a low wettability, preferably such that the "wettability index," i.e., the average of the advancing and receding contact angles of a drop of pure distilled water on the non-stick surface has a value of equal to or greater than about 90 degrees when determined in accordance with the controlled laboratory conditions and testing methodology described herein.

The article of footwear having a non-clogging sole in the present invention utilizes an adhesion prevention material in those areas where clogging is most probable to occur, e.g., in the area about the base and sides of the cleats or traction members and the generally planar ground engaging surface therebetween, and in particular, in those areas characterized by dramatic contours; but, it also retains at least on the tip of the cleat or traction member a material that will afford the wearer adequate traction and safety on and off the athletic field and even when walking on relatively flat and smooth man-made support surfaces such as asphalt, cement, or tile.

The non-clogging sole thus prevents the build-up of foreign matter, e.g., grass or earth, which had to be manually removed from the soles of prior art footwear in order to restore the desired level of traction quality and to prevent the soiling of clothes and indoor environments.

Further, the article of footwear in a preferred embodiment has a reduced cleat height and an adhesion prevention ground engaging surface which lessens the wear and damage to natural playing surfaces.

In addition, the article of footwear in a preferred embodiment can serve to enhance comfort, performance, and reduce the probability of certain athletic injuries.

DETAILED DESCRIPTION OF THE PREFERRED EMBODIMENTS

Figure 1:
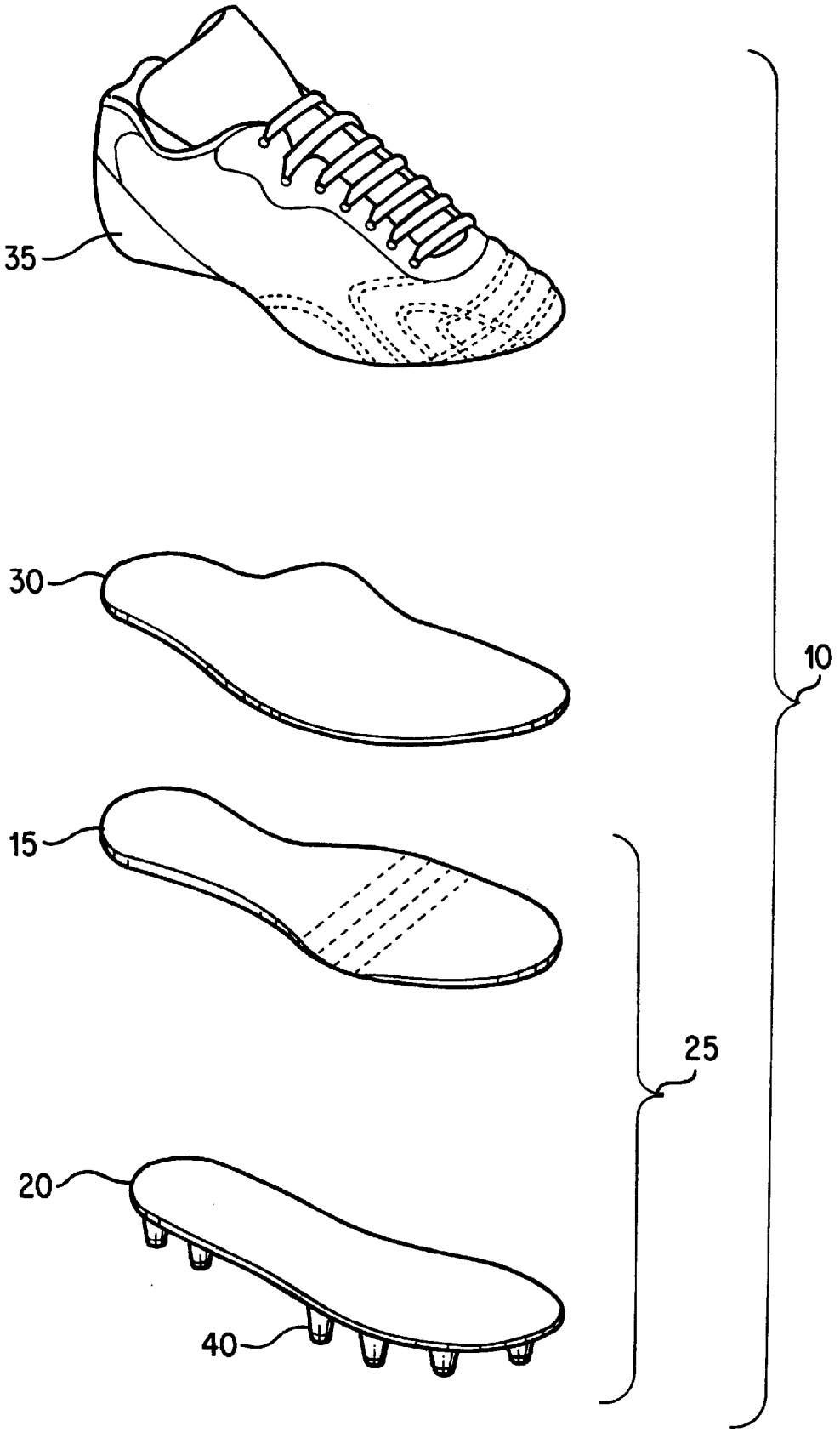
FIG. 1 is an exploded view of an article of footwear having a non-clogging sole in accordance with the present invention.

A conventional article of footwear having a non-clogging sole in accordance with a preferred embodiment of the present invention is illustrated generally as 10 in FIG. 1. As shown, a typical article of footwear 10 includes a sole 25 that forms a non-clogging outsole 20 which can also include an optional midsole 15 thereabove. A shoe upper 35 is attached to either the midsole or outsole to form article of footwear 10. A sock liner 30 can be placed within shoe upper 35 if desired.

Figure 2:
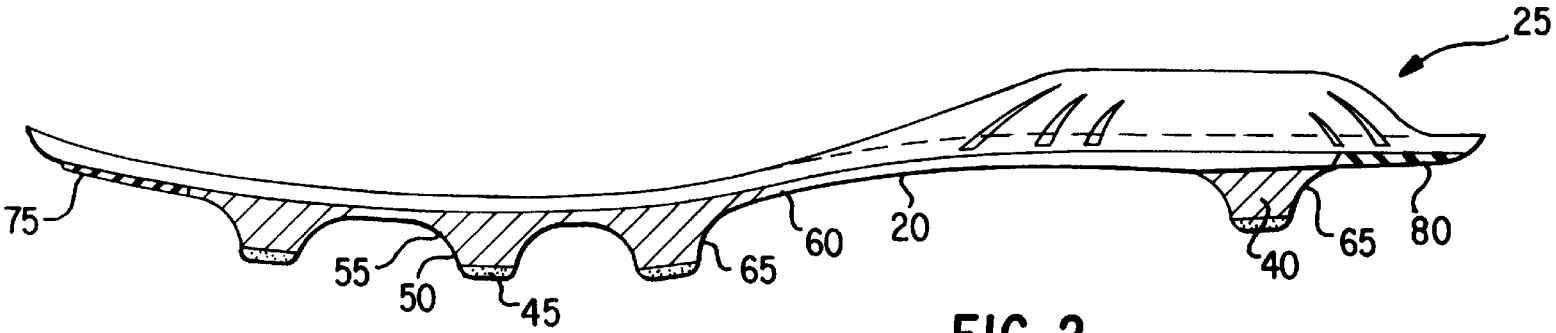
FIG. 2 is a side view of one embodiment of the non-clogging sole.
Figure 2A:
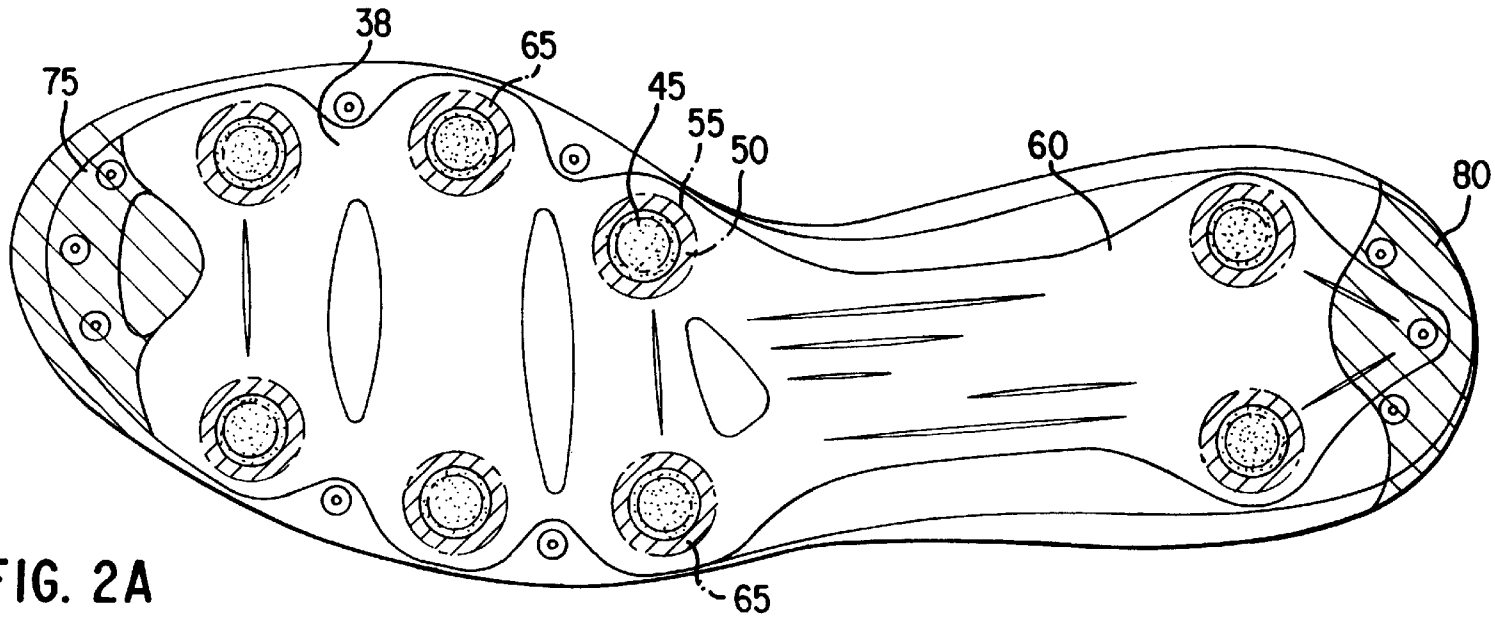
FIG. 2A is a bottom plan view of the sole shown in FIG. 2.

Referring to FIGS. 2 and 2A, outsole 20 further includes a plurality of traction members 40 each having a tip or distal portion 45, sides 50, and a base 55 that is adjacent or proximate the generally planar ground engaging surface 60 of the sole 25 of article of footwear 10. Traction members 40 can include cleats, spikes, lugs or any other type of element utilized for improving the traction of the sole with the ground. Although ground engaging surface 60 is generally planar, it nevertheless can include some degree of curvature so as to correspond to the natural shape of the wearer's foot.

In a preferred embodiment of the invention, at least the surface of the base 55 and sides 50 of the traction members 40 includes a substantially non-stick or adhesion prevention material 65, the requirements and selection of which are discussed in detail below. Methods for incorporating the adhesion prevention material in the desired locations are also discussed in detail below. It is also advantageous for the adhesion prevention material 65 to be positioned in those areas having relatively sharp contours where foreign matter from natural surfaces, e.g., grass and dirt, would normally become affixed and result in clogging, such as the area of the ground engaging surface 60 of the sole 25 adjacent or between the traction members 40. Accordingly, it can also be advantageous for the base 55 and sides 50 of the traction members 40 and the adjacent area of the ground engaging surface 60 to have a relatively gradual curvature, e.g., be gently tapered or curvilinear, in order to avoid the creation of areas where foreign matter would tend to adhere.

Figure 3:
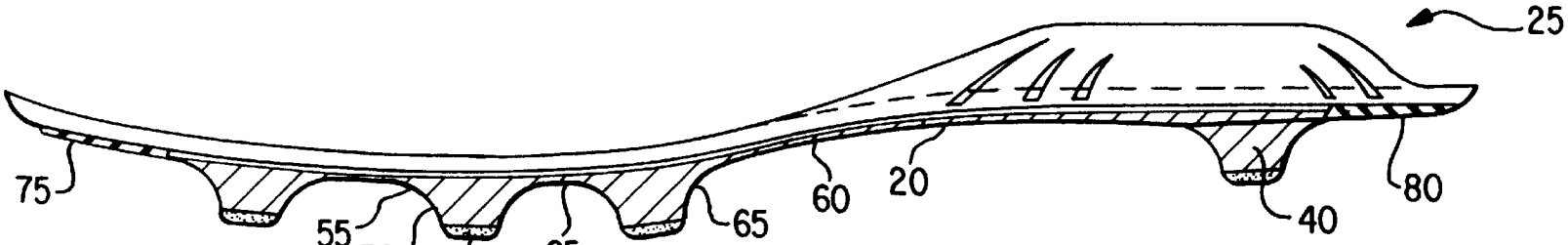
FIG. 3 is a side view of another embodiment of the non-clogging sole.
Figure 3A:
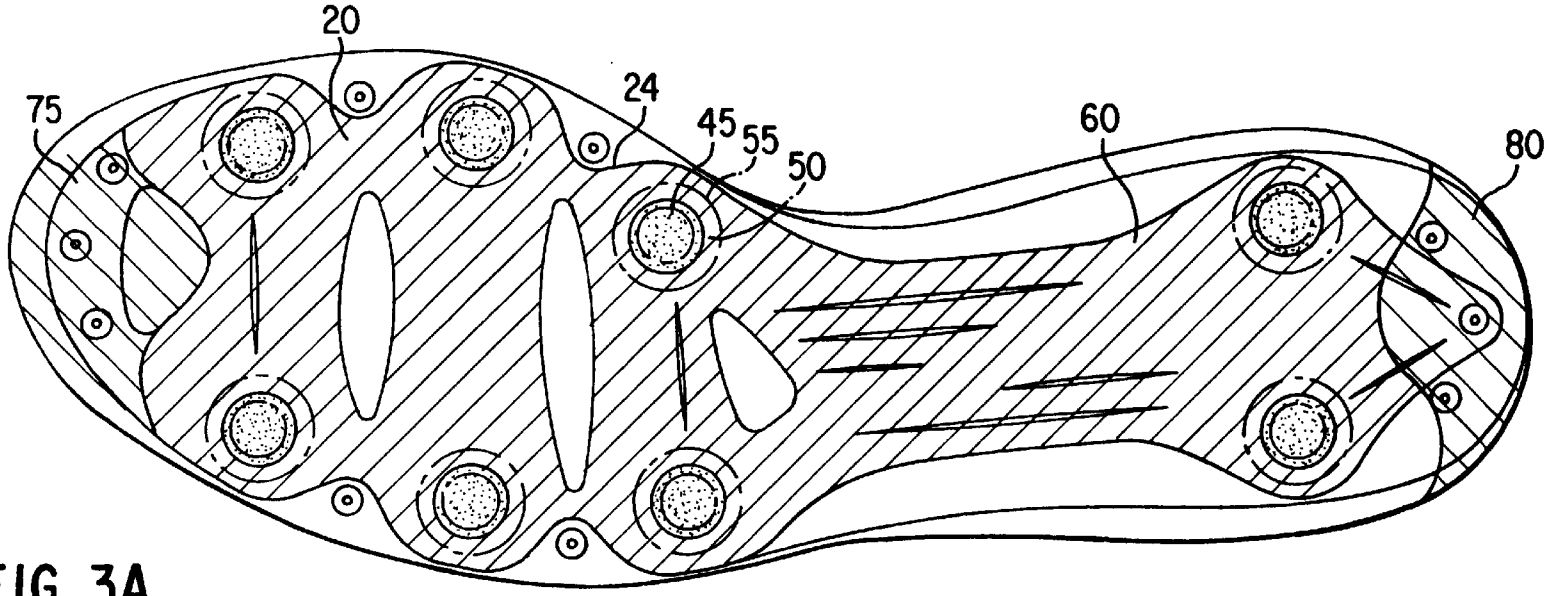
FIG. 3A is a bottom plan view of the sole shown in FIG. 3.

In accordance with the present invention, the portion of sole 25 having adhesion prevention material 65 can include some or all of the ground engaging surface 60 thereof as shown in FIGS. 2A and 3A. In some applications, it can also be advantageous for considerations of traction that an anterior portion 75 and a posterior portion 80 of the ground engaging surface 60 not include the non-stick material 65. Thus, these portions of the outsole layer 25 can be made from conventional materials, e.g., leather, plastic material, natural or synthetic rubber, open or closed cell foam material, or a bladder substantially filled with a gas, whether in partial or complete combination.

Briefly, the preferred substantially non-stick or adhesion prevention material 65 can be introduced with respect to the outsole 20 by any number of means, e.g., as a monolithic piece, laminate, insert, coating, filler, particle, fibril, fiber, fabric, sheet, film, foam, textile, metal matrix or graphite composite, or mat. The preferred adhesion prevention materials may be generally classified into three types.

Type I: Neat polymers include fluoropolymers, silicones, fluorosilicones, and the like. Some possible preferred neat polymers are listed in Table I below. These materials may be compounded with pigments, fillers, reinforcements, lubricants, processing aids, and curatives to make commercially useful compositions.

TABLE I

Some Preferred Type I Anticlogging Materials

| Chemical Name with Abbreviation | Trade Name | Manufacturer |
|---|---|---|
| Polytetrafluoroethylene (PTFE) | Teflon ® PTFE | DuPont |
| | Fluon ® PTFE | ICI America |
| | Fluorocomp ® PTFE | ICI America |
| | Hostaflon ® PTFE | Hoechst-Celanese |
| | Polyfon ® PTF | Daikin |
| | Algoflon ® PTFE | Ausimont |
| | Halon ® PTFE | Ausimont |
| Poly(tetrafluoromethylene-co-hexafluoropropylene) (FEP) | Teflon ® FEP | DuPont |
| | Neoflon ® FEP | Daikin |
| Polytrifluoroethylene (P3FE) | | |
| Polyhexafluoroethylene (PHFP) | | |
| Poly(tetrafluoroethylene-co-chlorotrifluoroethylene) (TFE/CTFE) | | |
| Poly(tetrafluoroethylene-co-pefluoroalkylether) (FFA) | Teflon ® PFA | DuPont |
| | Hyflon ® PFA | Ausimont |
| | Neoflon ® PFA | Daikin |
| Poly(tetrafluoroethylene-co-perfluoroalkylether + cure site monomer) fluoroelastomer | Kalrex ® fluoroelastomer | DuPont |
| Poly(vinylidene fluoride-co-hexafluoropropylene + cure site monomer) fluoroelastomer | Viton ® fluoroelastomer | DuPont |
| | Fluorel ® fluoroelastomer 3M | |
| Poly(vinylidene fluoride-co-tetrafluoroethylene + cure site monomer) fluoroelastomer | Viton ® fluoroelastomer | DuPont |
| | Fluorel ® fluoroelastomer | 3M |
| Poly(tetrafluoroethylene-co-propylene + cure site monomer) fluoroelastomer | Aflas ® TFEP fluoroelastomer | Asahi Glass, 3M |
| Poly(ethylene-co-tetrafluoroethylene) (ETFE) | Tefzel ® EFTE | DuPont |
| | Halon ® ETFE | Ausimont |
| | Neoflon ® ETFE | Daikin |
| Polychlorotrifluoroethylene (CTFE) | Neoflon ® CTFE | Daikin |
| | Kel-F ® CTFE | 3M |
| | Aclar ® CTFE | Allied Signal |
| Poly(ethylene-co-chlorotrifluoroethylene) (ECTFE) | Halar ® ECTFE | Ausimont |
| Poly(vinylidene fluoride-co-chlorotrifluoroethylene) (PVDF/CTFE) fluoroelastomer | Kel-F ® fluoroelastomer | 3M |
| | Halar ® fluoroelastomer | Ausimont |
| Silicones | see reference Stoskoff(1994) | |
| Fluorinated silicones | see reference Stoskoff(1994) | |

Homopolymers of tetrafluoroethylene such as Teflon® PTFE are not melt-processable by conventional extrusion, injection molding or the like, whereas the various cited fluorocopolymers are melt processable and offer ease and flexibility in processing and compounding. In particular, the preferred melt-processable fluoropolymers include Tefzel® ETFE, Viton® fluoroelastomer, Teflon® FEP, Fluorel® fluoroelastomer and Aflas® fluoroelastomer.

Tefzel® ETFE is an alternating copolymer of ethylene and tetrafluoroethylene, and is a plastic material. Aflas® TFEP is an alternating copolymer of tetrafluoroethylene and propylene, and is a fluoroelastomer. References are made herein to *Plastics Technology Manufacturing Handbook and Buyers Guide*, Bill Communications, Inc., New York, 1995, to *An Overview of Fluorocarbon Elastomers* by A. Stoskoff, 3M Company, St. Paul, Minn., presented at the Tlargi Technical Conference, May 18, 1994, to *Tetrafluoroethylene-Propylene Copolymer* (*Aflas®*): *An Overview*, by D. E. Hull, 3M Company, St. Paul, Minn., 1988, and to *Handbook of Elastomers*, A. K. Bhowmick and H. L. Stephens, editors, Marcel Dekker, New York, 1988, pp. 485–502, the disclosures of which are each incorporated herein by reference.

Notice that not all copolymers of a given generic composition may be useful, since the properties of a copolymer depend on the comonomer ratio. For instance, Viton® and Fluorel® fluoroelastomers are copolymers of vinylidene fluoride with hexafluoropropylene or tetrafluoroethylene with or without cure site monomer. When the flourine content is between 66 to 70%, the copolymer is an elastomer, whereas above or below this range, the copolymer is a plastic.

Type II: Polyblends include miscible (having homogeneous microstructure) and immiscible (having heterogeneous microstructure) blends of two or more Type I neat polymers, or blends of one or more Type I neat polymers with conventional materials such as natural rubber, styrene-butadiene rubber, nitrile rubber, ethylene-propylene rubber, EPDM (ethylene-propylene-diene) rubber, ethylene-vinyl acetate copolymer, neoprene rubber, urethane rubber, thermoplastic elastomers (such as polypropylene-EPDM thermoplastic elastomer), silicone, polyethylene, polypropylene, nylon, poly(vinyl chloride), and the like. Notice that not all polyblends of a given generic composition may be useful, since the properties of a polyblend depend on the compositional ratio.

In particular, relatively small amounts of Tefzel® ETFE or Aflas® TFEP may be melt blended in the conventional sole materials cited above to make materials having a good non-stick performance.

Type III: Surface active additives include surfactants, fluorinated acrylics, and filers. They may be added to form an integral blend with Type I neat polymers, Type II polyblends, or other conventional materials as noted before to obtain anticlogging performance. These additives have very low surface energies, i.e., much lower than those of the matrix materials, and so tend to migrate to and accumulate on the surfaces of the matrix materials. Usually addition of less than about 5% and often even less then 1% of such an additive may be sufficient to obtain the desired performance. Oligomeric or liquid-like additives may continue to "bloom" to and "renew" on the surface, when worn off during usage.

Zonyl® fluorosurfactants, made by DuPont are an example of preferred surface active additives. The technical information relating to these products is disclosed in *Zonyl® Fluorochemical Intermediates*, Technical Information published by DuPont, January 1994 and *Zonyl® Fluorosurfactants*, Technical Information published by DuPont, August 1993, the disclosures of which are each incorporated herein by reference. Examples of fluorinated acrylics having very low surface energies are listed by S. Wu in *Polymer Handbook*, 3rd ed., J. Brandrup and E. J. Immergut, editors, Wiley-Interscience, New York, 1989, pp. VI/411–434, the disclosure of which is incorporated herein by reference.

An example of Type I material used as a surface active filler is Alphaflex® PTFE material, sold by Alphaflex industries, Indianapolis, Indiana, and taught in U.S. Pat. No. 4,596,839 and U.S. Pat. No. 4,962,136, the disclosures of which are each incorporated herein by reference. These are granules of PTFE particles blended and treated with molybdenum sulfide (a solid lubricant). When added into elastomeric materials, the PIPE particles can fibrillate in-situ during mastication or milling to form webs of fibrils in the bulk and the surface of the blend, and thus impart reinforcement and anticlogging performance to the elastomeric materials. Alternatively, Teflon® PTFE powder, which can fibrillate and form webs of fibrils during mastication or milling to impart anticlogging performance, may be used as an additive. Furthermore, preformed PTFE fibrils may also be used instead as an anticlogging additive.

Preferred materials for use as adhesion preventing textiles include Teflon® PFTE coated fabrics of fiberglass made by Fluorglas, a division of Allied Signal, Hoosick Falls, N.Y. The same manufacturer also makes a variety of Teflon® PIPE tapes with self-adhesive backing.

These materials are described in the following Fluorglas advertising brochures, "Teflon® Coated Fabrics from Fluorglas," published December 1993; "Teflon® Coated Belts from Fluorglas," published January 1989; "Teflon® Shapes from Fluorglas," published April 1989; and Allied Signal advertising brochures, "Advanced Materials," published November 1993 and "Advanced Materials, Wire, Cable & Hose Materials," published September 1993, the disclosures of which are each incorporated herein by reference.

An adhesion preventing material, e.g., a fluoropolymer or silicone polymer, could also be included into graphite composites or metal matrix composite materials and could thereby impart thereto desired material characteristics.

In a preferred embodiment, adhesion prevention material 65 has a low coefficient of friction between 0.1 and 0.3, and a low wettability with respect to water, preferably thereby being characterized such that the wettability index (i.e., the average of the advancing and receding contact angles of a distilled water drop on the adhesion prevention material) is equal to or greater than about 90 degrees when determined in accordance with the methodology described below. Particular details and the principles for the selection of adhesion prevention material 65 and determination of its wettability index are discussed below.

When the adhesion prevention material is a laminate or material insert, the thickness of material 65 is determined so as to permit sufficient wear vis-a-vis abrasion and durability during use and resistance to fatigue failure in bending. Preferably, when the adhesion prevention material 65 is applied as a layer of material, whether applied by lamination, dip coating, spray coating, or some other method, it is advantageous that it generally have a thickness of less than 1.5 mm in order to save weight and reduce the expense of manufacture.

The tip 45 of the traction members 40 can be made of a natural or synthetic rubber material, plastic material, metal, metal matrix composite, ceramic, and the like. In contrast to the adhesion prevention material 65 used elsewhere on the shoe sole 25, the tips 45 of the traction members 40 are preferably made from a material having a coefficient of friction greater than 0.4 and are characterized by a high degree of wettability relative to the adhesion prevention material. Thus, having a rubber tip 45 on cleats 40, the user still obtains the non-clogging benefits provided from adhesion prevention material 65, yet he or she is also able to safely walk off of a natural field and onto firm man-made surfaces such as cement or asphalt.

As shown in PIGS. 3 and 3A, in a further preferred embodiment adhesion prevention material 65 can be a solid matter comprising a thin laminate, a dipped surface, or a sprayed surface on a portion of the ground engaging surface 60 of outsole 20. The use of a thin layer of material 65 can reduce the weight and expense of the shoe sole 25. Further, the use of a different material in conjunction with adhesion prevention material 65 allows desired physical and mechanical properties to be selectively determined in one or more regions of the shoe sole 25. As shown in FIG. 3, adhesion prevention material 65 is preferably positioned proximate the base and sides of the traction members 40, but not on tips 45, and substantially covers the ground engaging surface 60. Again, it is most advantageous that the material 65 be positioned in areas having a sharp curvature or contour, e.g., in the transitional areas at the base 55 of protruding traction members 40.

Figure 4:
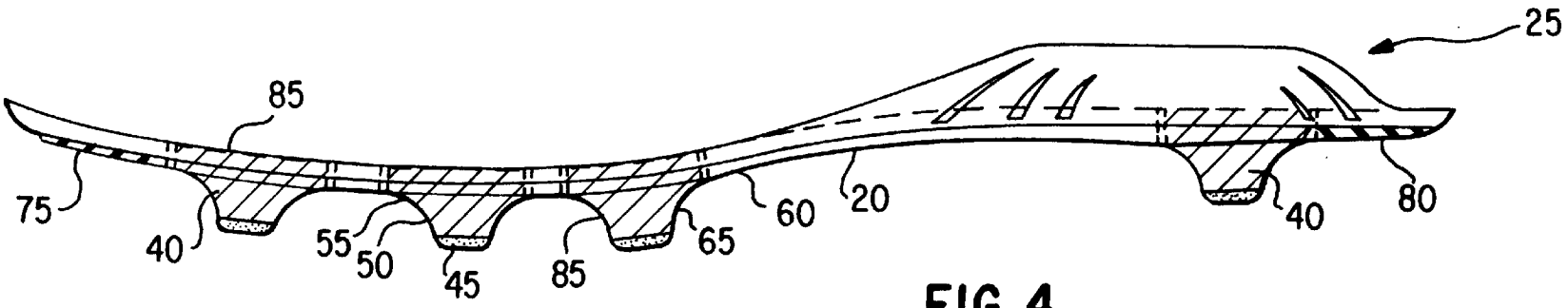
FIG. 4 is a side view of a further embodiment of the non-clogging sole.
Figure 4A:
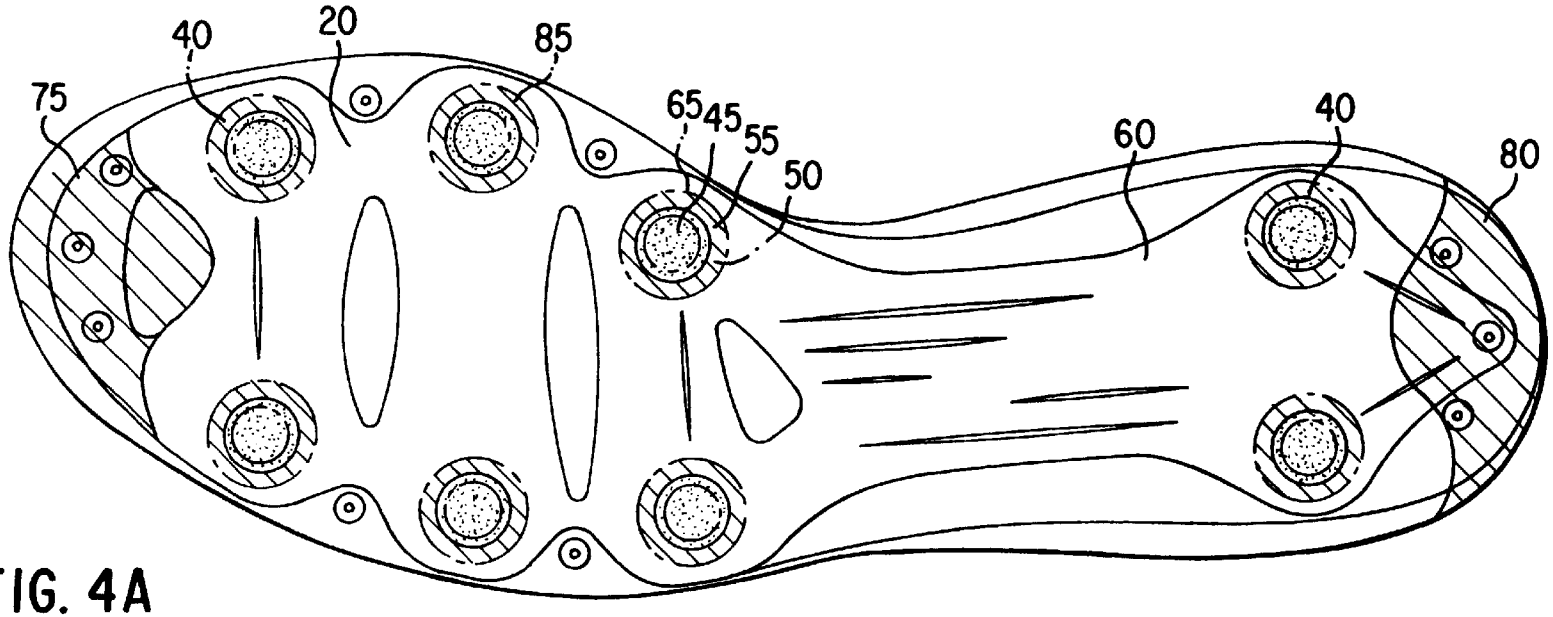
FIG. 4A is a bottom plan view of the sole shown in FIG. 4.

FIGS. 4 and 4A illustrate a sole 25 in accordance with a further embodiment of the present invention, preferably for use on a soccer shoe. Sole 25 includes an adhesion prevention insert 85 used in the area proximate the base 55 of cleats or traction members 40. As shown in FIG. 4A, insert 85 can be generally ring shaped, but other shapes can be used as well. The adhesion prevention insert 85 can be integrally formed with the sole 25 upon manufacture, e.g., the insert 85 is pre-positioned or co-injected during an injection molding process, or pre-positioned in a compression molding process. Alternately, insert 85 can form a detachable cleat base 55' in conjunction with a two-part detachable cleat 40', as shown in detail in FIG. 4B and discussed below.

Figure 4B:
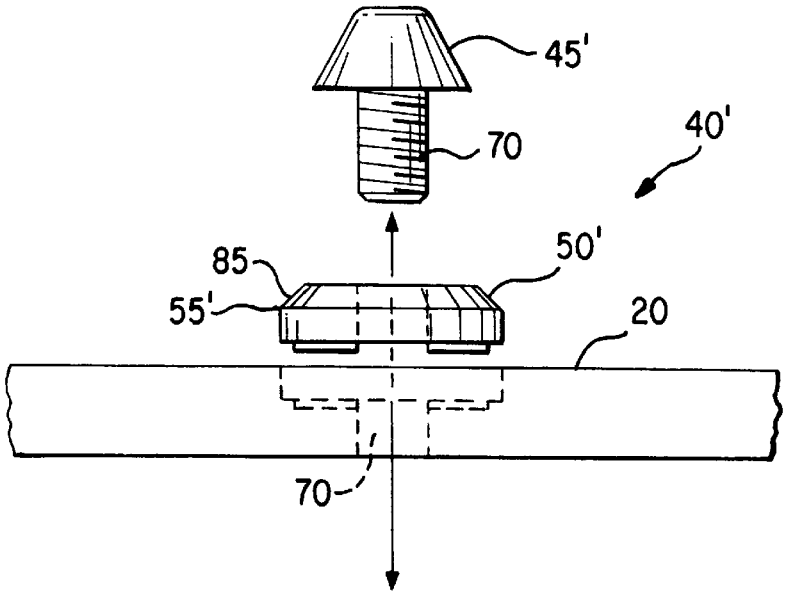
FIG. 4B is an exploded view of the insert shown in FIG. 4.
Figure 5:
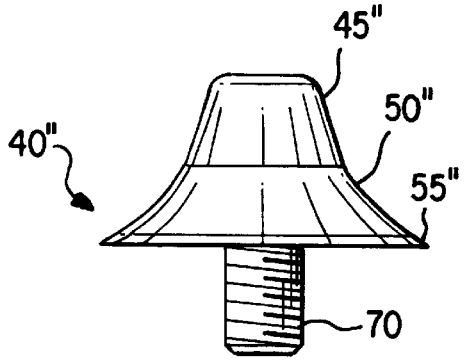
FIG. 5 is a side view of one embodiment of a detachable cleat in accordance with the present invention.
Figure 6:
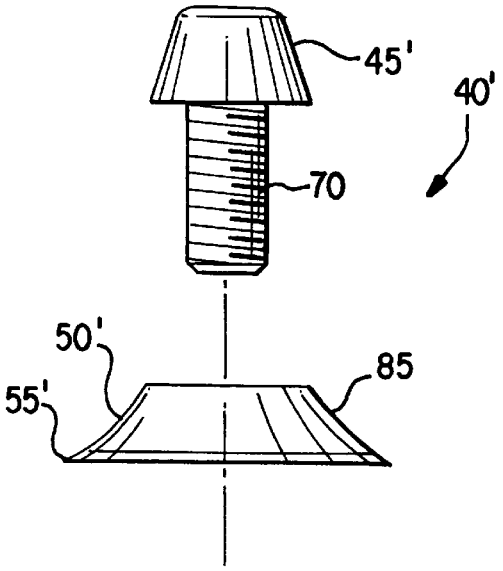
FIG. 6 is a side view of another embodiment of a detachable cleat.

Referring also to FIGS. 5 and 6, the tips 45 of the cleats or traction members 40 can be separate tip elements, or an integral portion of the sole 25 as shown in FIG. 1. That is, the tip 45" can be part of a detachable cleat 40", as shown in FIG. 5, or detachable tip 45' can be part of a detachable cleat 40' having a plurality of parts as shown in FIGS. 4B and 6. Obviously, the cleat or traction member 40 can also be integral to at least a portion of the sole 25 of an article of footwear 10, as shown in FIG. 1. FIG. 5 illustrates a detachable cleat 40" having a base 55", sides 50", tip 45", and an attachment element 70. Attachment element 70 is preferably a threaded screw for attaching to a receptacle positioned in the shoe sole 25, although other conventional mechanisms for attachment 70 could be used. The tip 45" preferably has a nitrile based rubber material with a hardness of approximately 85 Shore A durometer. Alternately, metal, e.g., stainless steel, aluminum, titanium, metal matrix composite, ceramic, styrene butadiene based rubber, urethane, thermoplastic urethane, plastic, e.g., polyamide, and the like, could be used in making the tip 45" of the detachable cleat 40" if desired, depending upon the intended end use. The surface of the base 55" of the detachable cleat 40" and at least a portion of the sides 50" are coated, made from, or otherwise include adhesion prevention material 65.

FIG. 6 illustrates a two-part detachable cleat 40' having an adhesion prevention insert 85 including base 55' and sides 50', and a tip 45' with attachment element 70. Again, the tip 45' can be made of nitrile or styrene butadiene rubber, a plastic material, metal, ceramic, and the like in order to safely allow the user to walk on smooth man-made surfaces. The surface of the base 55' and sides 50' preferably are adhesion prevention material 65 in order to prevent the cleat from becoming clogged with grass or mud when used on a natural playing surface. The base 55' of the two-part detachable cleat 40' is held fast by the tip 45' when it is attached to the shoe sole 25'.

Figure 7:
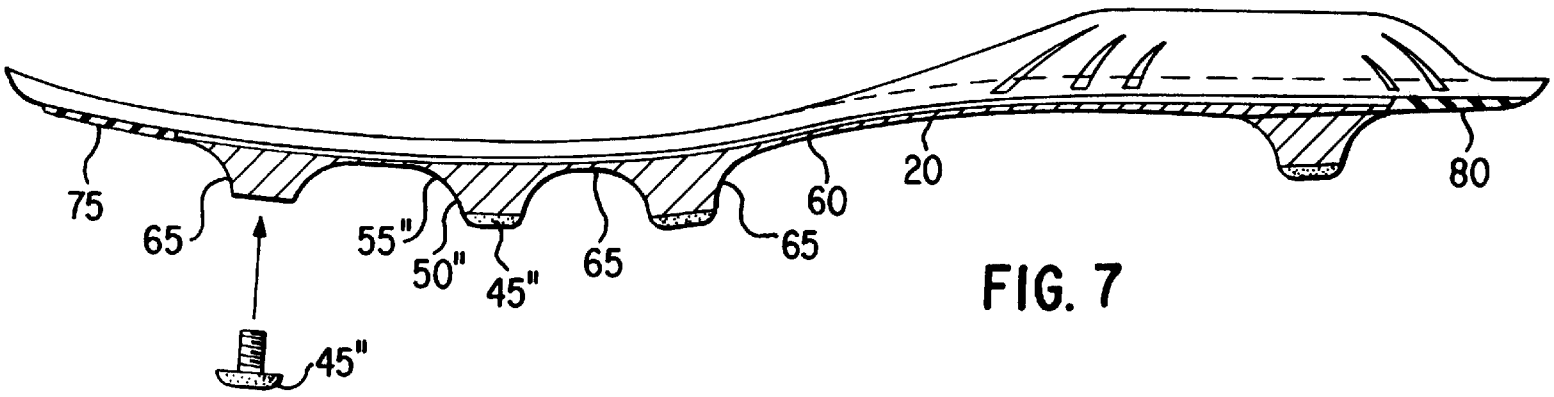
FIG. 7 is a side view illustrating the assembly of a sole in accordance with one embodiment of the present invention.

FIG. 7 illustrates the application of detachable tip 45' to ground engaging surface 60 of outsole 20 including adhesion prevention material 65.

Figure 8:
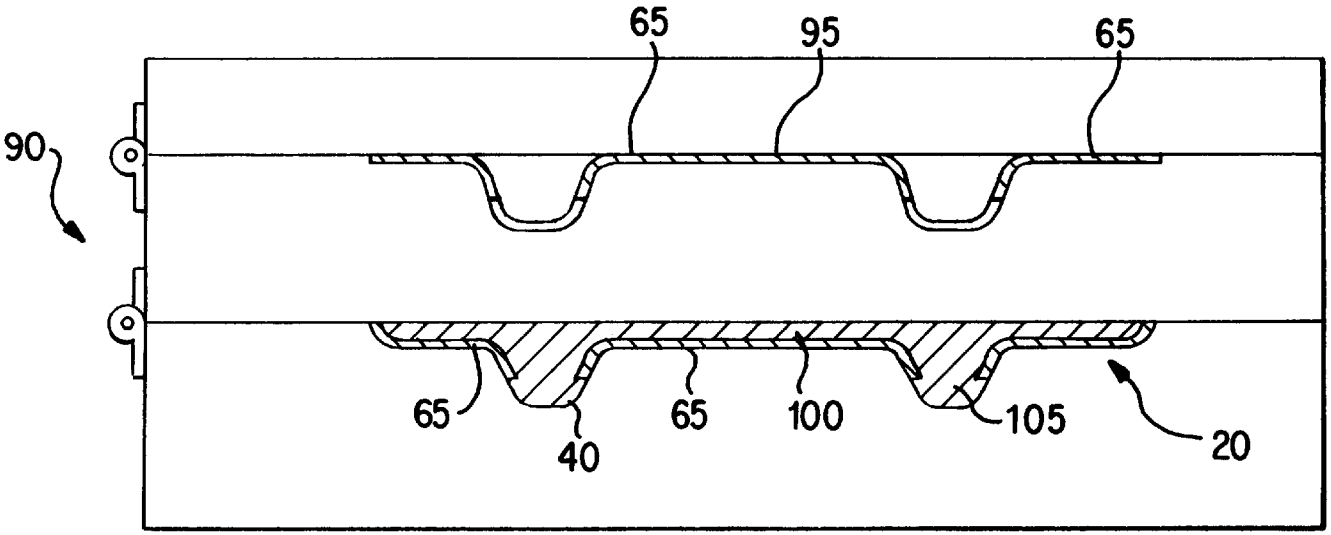
FIG. 8 is a sectional view illustrating the sole of the present invention being made in a three part mold.

FIG. 8 shows a transverse cross-sectional representation of an outsole 20 being made in accordance with the present invention in a three part mold 90 having two cavities 95 and 100. The upper cavity 95 is for molding a quantity, e.g., a skived sheet or film, of adhesion prevention material 65 to a desired three-dimensional shape. The lower cavity 100 is for molding a second material 105 of choice using heat and pressure and causing it to bond to the non-stick material 65.

Figure 9:
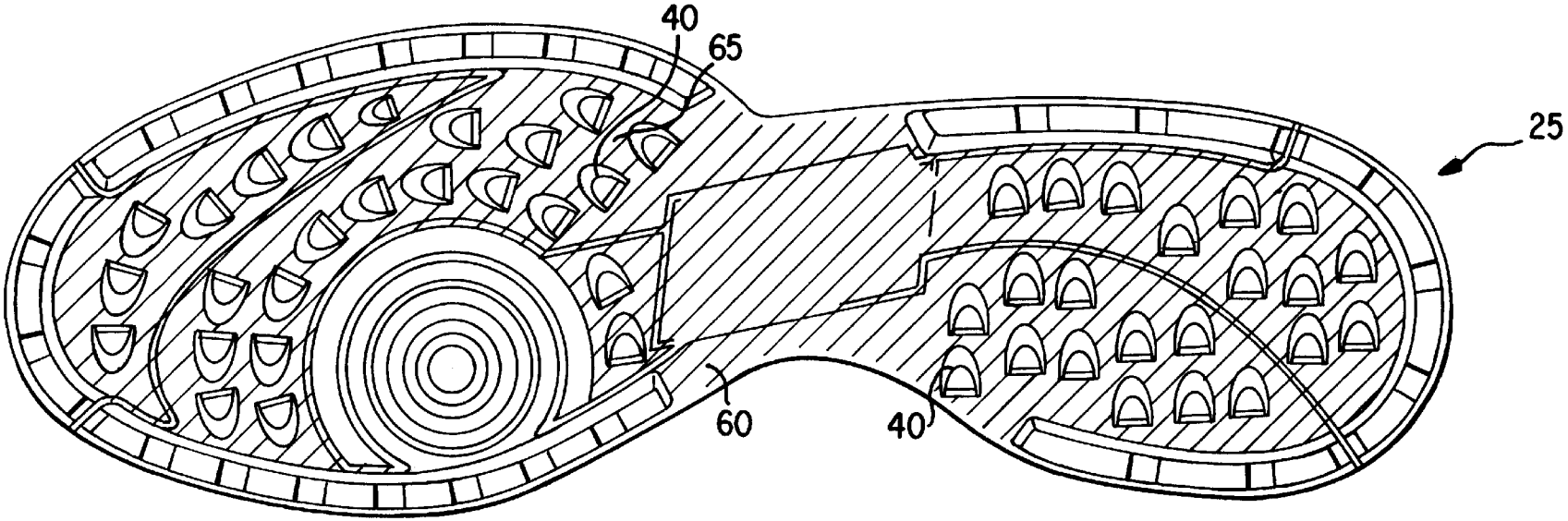
FIG. 9 is a bottom plan view of an outsole in accordance with the present invention.
Figure 9A:
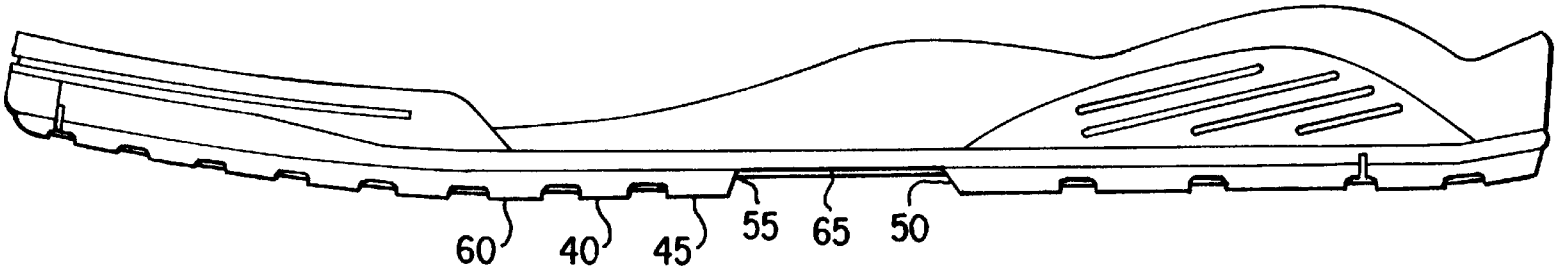
FIG. 9A is a side view of the outsole shown in FIG. 9.
Figure 10:
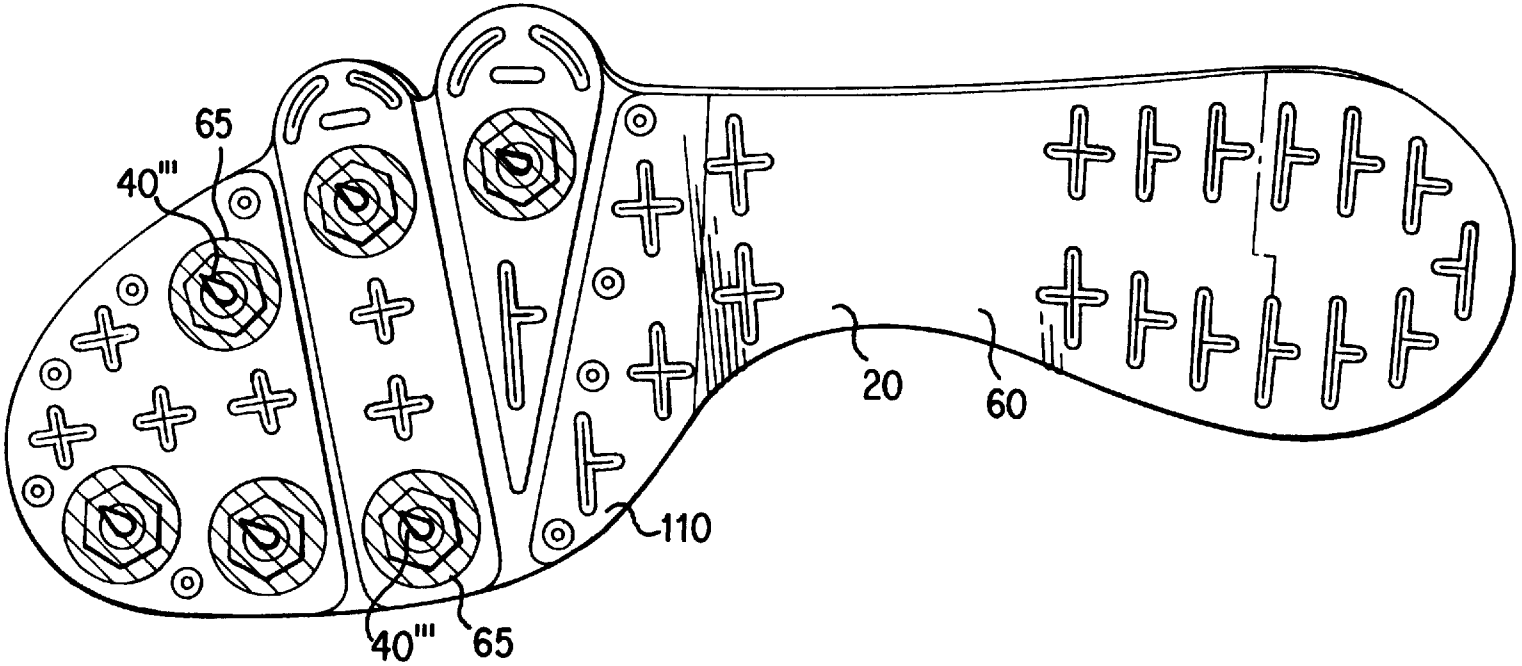
FIG. 10 is a bottom plan view of an outsole spike plate including a spike traction member in accordance with the present invention.

Although an outsole 20 of a soccer shoe is shown as an example of the present invention, it can be readily understood that ground engaging surfaces of other athletic and non-athletic footwear can be similarly constructed, e.g., articles of footwear for track & field, football, golf, baseball, and work and hiking shoes and boots. More particularly, FIGS. 9 and 9A illustrate one desired pattern and configuration of traction members 40 for use on natural surfaces. Consistent with the discussion found in the background section, it is generally advantageous for the number of cleats, lugs, or traction members 40 to be at least equal to or greater than six, and that the length of the cleats, lugs, or traction members 40 be less than or equal to one half inch. In addition, FIG. 10 shows the ground engaging surface 60 of an outsole spike plate 110 suitable for use in cross-country running including detachable spike traction members 40'''. The presence of adhesion prevention material 65 is shown on the ground engaging surface 60 in the area adjacent to the base of the detachable spike traction members 40'''.

Figure 11:
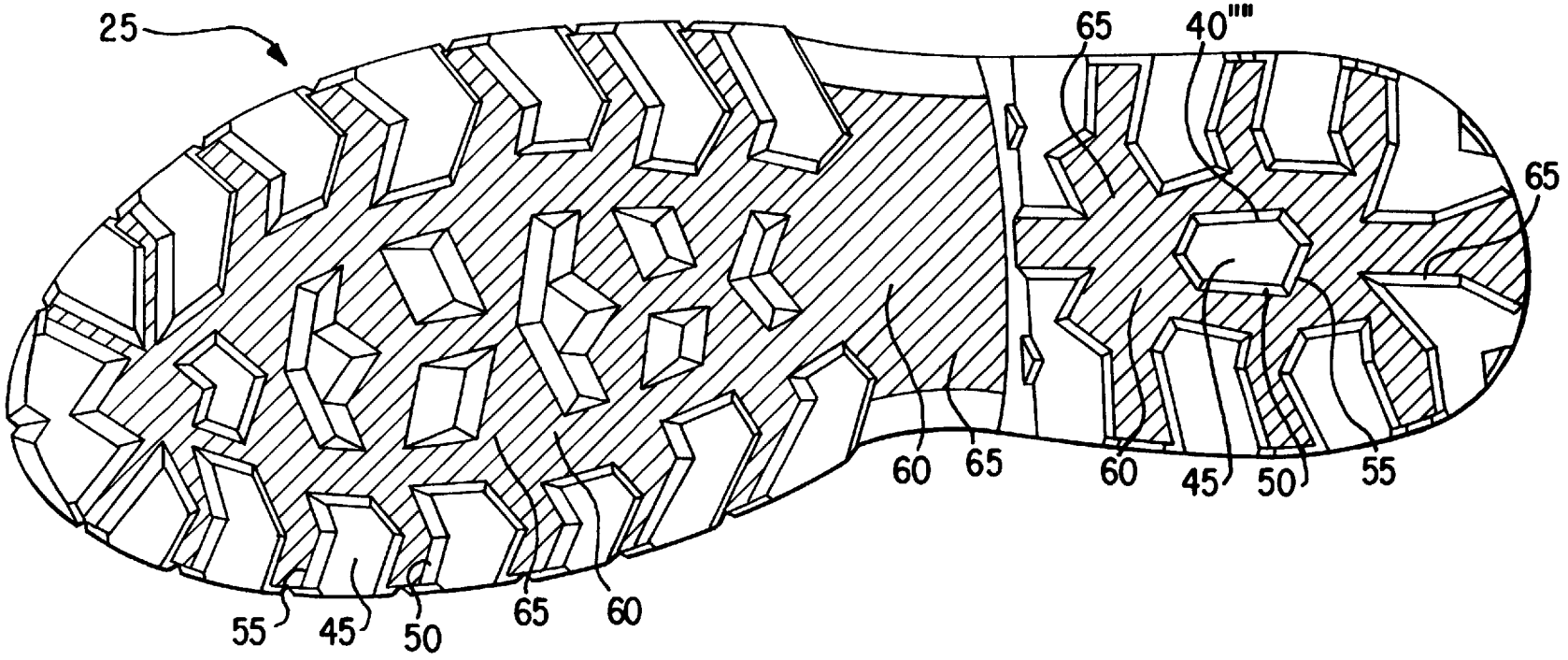
FIG. 11 is a bottom plan view of an outsole of a hiking boot in accordance with the present invention.

FIG. 11 shows a plan view of the outsole 20 of a hiking boot including an adhesion prevention material 65 on the ground engaging surface 60 of the sole 25. As shown, the adhesion prevention material 65 extends to the base 55 and sides 50 of the traction members 40'''', but not the tip 45. In an alternate embodiment, the use of the adhesion prevention material can be more limited, and end adjacent to the base of the traction members.

Figure 12:
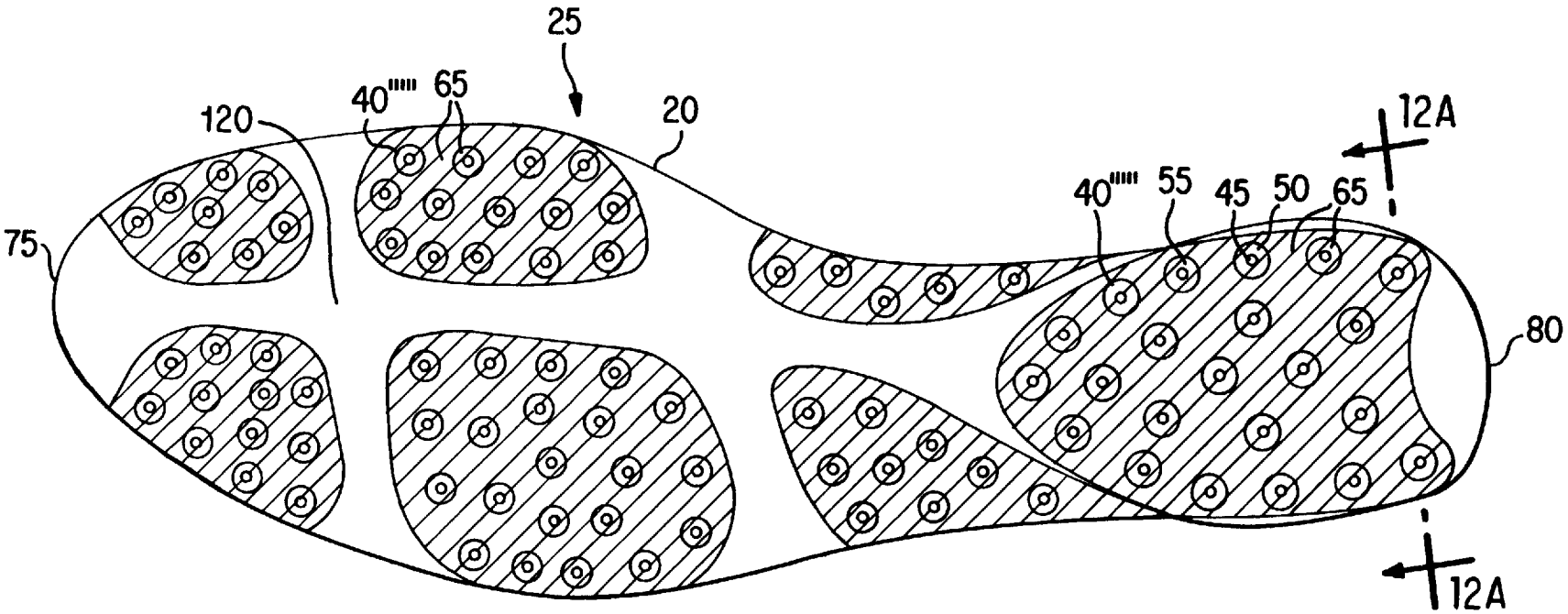
FIG. 12 is a bottom plan view of an outsole of a soccer shoe for use on grass surfaces.

FIG. 12 shows a plan view of a preferred outsole 20 of a soccer shoe for use on a natural grass surface including an adhesion prevention material 65 on the ground engaging surface 60 of the sole 25. As shown, the adhesion prevention material 65 extends about the base 55 and sides 50 of the traction members 40''''' with the exception of the anteriormost ground engaging portion of the tips 45. The tip 45 of the traction members 40''''' can be made from a textile, bristle, natural or synthetic rubber, plastic, metal, e.g., stainless steel, aluminum, or titanium, or a composite material, e.g., a graphite or carbon fiber composite, or metal matrix composite, which has been, e.g., largely encapsulated, or otherwise provided with a surface layer of an adhesion prevention material 65 thereabout. The material for the tips 45 of the traction members can be introduced in the sole as individual elements, or in the form of a continuous and interconnecting network, e.g., as shown in U.S. Pat. No. 4,085,526, hereby incorporated by reference herein. The sole can also be provided with desired lines of flexion 120, e.g., as recited in U.S. Pat. No. 5,384,973, hereby incorporated by reference herein.

Figure 12A:
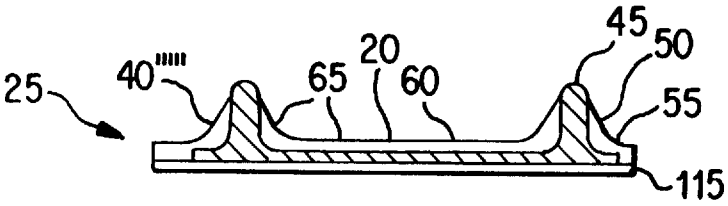
FIG. 12A is a cross-sectional view of the outsole of FIG. 12, along line 1—1.

FIG. 12A shows a cross-sectional view of the sole 25 of FIG. 12, along line 1—1. The material used to form the tips 45 is represented as consisting of a continuous and interconnecting network. It can be seen that the adhesion prevention material 65 encompasses the base and sides of the traction members 40''''' and a portion of the ground engaging surface 60 of the outsole 20. Also shown in FIG. 12A is the optional use of an intermediate material 115, which can consist of, e.g., a natural or synthetic textile, a plastic material, e.g., polyurethane film, or PEBAX®, a polyamide material made by Elf AtoChem of Paris, France, a natural or synthetic rubber, a metal material, or composite material. The material of the tip 45 could be formed separately with respect to the intermediate material 115 and subsequently affixed thereto, as shown, or formed in conjunction as an integral unit (not shown).

As discussed briefly above, the adhesion prevention material 65 in the present invention has (1) a low coefficient of friction generally less than 0.4, and preferably, between 0.1 and 0.3, as measured in accordance with approved ASTM (American Society of Testing and Materials) protocols and (2) a low wettability with regard to water, preferably thereby being characterized such that the average of the advancing and receding contact angles of a pure distilled water drop on the adhesion prevention material, i.e., wettability index, is equal to or greater than about 90 degrees, when determined as described below.

Fluoropolymers, and silicone based polymers commonly exhibit a coefficient of friction of less than 0.4. To assist in the selection of an appropriate material, shown below in Table II is the mean kinetic coefficient of friction of polyurethane, polypropylene, nylon, Teflon® PTFE, and ultra high molecular weight polyethylene and other materials. The data shown in Tables II and III were obtained by Dr. Gordon Valiant of the NIKE Sports Research Laboratory by testing samples in the form of a smooth flat plate on an Astroturf surface at an average velocity of 0.53 meters per second and under an average load of 840 newtons, thereby generally simulating the velocity and load associated with human movement.

TABLE II

Mean Kinetic Coefficient of Friction for Flat Plates on Astroturf ® Surface

| Material | Mean Kinetic Coefficient of Friction |
|---|---|
| Nitrile Rubber | 0.9 |
| Styrene-butadiene rubber | 0.7 |
| Polyurethane | 0.6 |
| Polypropylene | 0.4 |
| Nylon 6 | 0.3 |
| Polyethylene (UHMW) | 0.2 |
| Teflon ® polytetrafluoroethylene | 0.2 |

Note: UHMW = ultra high molecular weight

For further comparison, shown below in Table III is the range of the kinetic coefficients of friction for various materials considered for use on the outsoles of footwear. Illustrated are the range of the kinetic coefficients of friction for styrene-butadiene rubber; nitrile rubber; a composition including 50% poly (vinyl chloride) and 50% nitrile rubber; a composition including 100 parts poly (ethylene-co-vinyl acetate), 10 parts Zeosil, and 10 parts $CaCO_3$; a composition including 100 parts poly (ethylene-co-vinyl acetate) and 60 parts Zeosil; and a composition including 100 parts poly (ethylene-co-vinyl acetate) with ultra high molecular weight polyethylene using the same test protocols cited in the preceding paragraph. Also shown for comparison are the mean kinetic coefficients of friction for four low friction materials taken from Table II.

TABLE III

Range of Kinetic Coefficient of Friction on Astroturf ® Surface Translational Traction of Flat Rectangular Specimens

| Material | Kinetic Coefficient of Friction |
|---|---|
| Styrene-butadiene rubber | 0.7 |
| Nitrile Rubber | 0.8~1.0 |
| Poly(vinyl chloride)/nitrile rubber, blend of 50 parts/ 50 parts | 0.8~1.0 |
| Poly(ethylene-co-vinyl acetate) /Zeosil/$CaCO_3$, blend of 100 parts/10 parts/10 parts | 0.9~1.2 |
| Poly(ethylene-co-vinyl acetate) /Zeosil, blend of 100 parts/ 60 parts blend | 0.6~0.8 |
| Poly(ethylene-co-vinyl acetate)/ UHMW polyethylene blend (*) | 1.0~1.2 |
| Polypropylene | 0.4 |
| Nylon 6 | 0.3 |
| Polyethylene (UHMW) | 0.2 |
| Teflon ® polytetrafluoroethylene | 0.2 |

Note: (*) UHMW = ultra-high-molecular-weight polyethylene

As illustrated by Tables II and III, in order to provide the proper coefficient of friction, adhesion prevention material 65 of the present invention can be a fluoropolymer, such as Teflon® PTFE.

It is possible to have two materials which by visual inspection with the naked eye and by human touch might seem quite smooth, and indeed, the coefficient of friction under dry conditions of the two materials could be relatively close. Nevertheless, with closer inspection by scanning electron microscopy differences in surface topography and roughness could be discerned. Moreover, in wet conditions, the coefficient of friction of the same two materials could differ greatly.

Article of footwear 10 of the present invention is intended to provide, at least in part, adhesion prevention material 65 having a specified coefficient of friction on certain portions of the outsole 20 which contact natural surfaces. The adhesion prevention surface 65 will therefore be exposed to the natural elements, e.g., to water, grass, soil and mud. Accordingly, in addition to the exhibited coefficient of friction, the wettability characteristic with respect to water of the adhesion prevention material 65 that is used in making the sole 20 is of critical concern, as this can largely determine the degree to which mud and the like will be able to adhere to the surface. In turn, the wettability of a material can also greatly influence the coefficient of friction exhibited by any given material when placed in a wet environment.

Therefore, one cannot presume that materials having a similar appearance and coefficient of friction in dry condition would behave similarly, i.e., have a similar traction and mud-release performance, on a natural playing surface. One should recognize that the wettability of a material can greatly affect its traction and mud-release performance, since the surface of a material may be hydrophilic (water-loving) or hydrophobic (water-hating), as determined by its chemical constitution and microstructure. The wettability is a measure of the degrees of hydrophilic characters of a surface.

It can also be advantageous that the adhesion prevention material used on outsole 20 be relatively chemically inert and impervious to various chemicals and environmental challenges to which the sole 25 of an article of footwear 10 is commonly exposed. In this regard, fluoropolymers are particularly suitable for use.

The low wettability of adhesion prevention material 65 used on outsole 20 of article of footwear 10 is of great importance in preventing cleated members 40 from clogging when used on natural playing surfaces. The low wettability and corresponding low surface tension and surface energy characteristic of a material, e.g., fluoropolymers, can be revealed by contact angle measurements. Table IV below illustrates examples of different contact angles of water at 30 degrees Celsius on various materials. The data from Table IV is taken from *Graphite Fluorides*, by N. Watanabe, T. Nakajima and H. Touhara, Elsevier, Amsterdam, 1988, p. 97.

TABLE IV

Contact Angles of Water at 30° C. on Various Materials

| Material | Contact Angle θ in Degrees |
|---|---|
| Glass | 27 |
| Polyethylene (PE) | 94 |
| Grafoil | 95 |
| Polytetrafluoroethylene (PTFE) | 109 |
| Fluorinated graphite: $(C_2F)_n$ tablet | 141 |
| Fluorinated graphite: $(CF)_n$ tablet | 143 |

As shown in Table IV above, the contact angle of water on a glass is 27 degrees, in contrast with polytetrafluoroethylene which provides a contact angle of 109 degrees. A high contact angle of water on a material indicates a low wettability of the material. Thus, polyetrafluoroethylene has a lower wettability than glass. The use of Teflon® polytetrafluoroethylene on non-stick aluminum cookware provides another example illustrating the relationship of contact angle and the low wettability and low surface energy characteristics of an adhesion prevention material. That is, a water drop on polished aluminum can have a contact angle of approximately 50 degrees, but after the utensil has been coated with a Teflon® PTTE coating a water drop can exhibit a contact angle of over 120 degrees. In the present invention, the wettability characteristic of the adhesion prevention material is preferably such that the wettability index (i.e., the average of advancing and receding contact angles as described later) of pure distilled water on the adhesion prevention material is equal to or greater than about 90 degrees.

FIGS. 14, 15, 16 and 17 are four drawings that illustrate the experimental observation of a water drop 130 placed on a specimen of Teflon® PTFE 131 (contact angle=109°), Tefzel® ETFE 132 (contact angle=96°), nylon 133 (contact angle=80°), and styrene-butadiene rubber 134 (contact angle=63°), respectively. The figures show that the contact angle of water on Teflon® PTFE is 46° greater than on styrene-butadiene rubber, and 29° greater than on the nylon material, whereas the contact angle of water on Tefzel® ETFE is 33° greater than on styrene-butadiene rubber, and 16° greater than on the nylon material.

Detailed discussion of contact angle, and its relationship to wettability and adhesion is presented in the book by S. Wu, *Polymer Interface and Adhesion*, Marcel Dekker, New York, 1982; the disclosure of which is incorporated herein by reference. A scientific theory of adhesion, concisely given below, correlates the contact angle directly to anticlogging performance.

Interfacial Theory of Adhesion and Release

The anticlogging performance of a shoe sole can be improved by reducing the attraction between the shoe sole and the clogging matter. The latter is usually a sticky paste of soil and/or grass mixed with water which serves as the primary liquid component. The interfacial theory regarding adhesion and release of the clogging matter from the shoe sole, presented below, is general in principle, and independent of the nature of the clogging matter.

To define the scope of the present invention, a testing liquid is used as a means of verification. An ideal testing liquid for such purpose would be a synthetic "muddy" water which could be an aqueous solution containing some of the essential surface activities of a typical real clogging matter. Such a standardized synthetic "muddy" water for such testing purposes is desirable but unavailable at this time. However, water is the main liquid component of the real clogging matter, and shares with the latter the most important surface attribute, i.e., the hydrophilicity. Therefore, the surface properties of water (distilled and uncontaminated) will be used to approximate those of a typical real clogging matter. For simplicity, the shoe sole will be referred to as the solid, and the clogging matter as the liquid water in the present analysis.

The energy of adhesion between a liquid and a solid is the work of adhesion, which is the free energy required to reversibly separate a liquid from a solid, given by $$W_a=(1+\cos\theta_o)\gamma_{LV} \quad (1)$$

where $W_a$ is the work of adhesion, $\theta_o$ the equilibrium contact angle, and $\gamma_{LV}$ the surface tension of the liquid in its saturated vapor.

The force of adhesion between a liquid and a solid is simply related to the work of adhesion by $$\delta_a=W_a/z_o=(1+\cos\theta_o)(\gamma_{LV}/z_o) \quad (2)$$

where $\delta_a$ is the force of adhesion, and $z_o$ is the equilibrium molecular distance between the two phases.

The value of $\cos\theta_o$ monotonically varies with the contact angle $\theta_o$. It has the highest value of unity, when the contact angle is zero (i.e., $\cos\theta_o=1$, when $\theta_o=0°$), decreases to zero, when the contact angle is 90° (i.e., $\cos\theta_o=0$, when $\theta_o=90°$), and reaches the lowest value of minus unity, when the contact angle is 180° (i.e., $\cos\theta_o=-1$, when $\theta_o=180°$).

Therefore, both the energy and the force of attraction between the sole and the clogging matter decreases with increasing contact angle, i.e., being directly proportional to $(1+\cos\theta_o)$. The anticlogging performance of a shoe sole may thus be improved by making the surface of the sole material such that water has as high a contact angle on it as practicable. In other words, the anticlogging performance improves with increasing contact angle of the clogging matter on the shoe sole.

The next question then concerns how high the contact angle must be in order to have useful anticlogging performance. This can be best answered by wear testing of footwear in varied environmental conditions. However, the associated variables and conditions, e.g., temperature, terrain, soil composition, grass type, humidity, saturation of the soil, footwear design, and so on, can approach the infinite. Accordingly, for the purpose of defining the present invention, the preferred range of contact angle must be made with reference to controlled laboratory conditions and methodology.

Consider a small liquid drop of a given volume placed on a flat solid surface. The drop will usually approximate a spherical cap. If the attraction between the liquid and the solid is strong, the drop will wet the solid surface and spread to form a broad spherical cap with a small contact angle and a large drop base radius and area. If the attraction is sufficiently strong, the drop will completely spread to form a thin film on the solid, the contact angle will be zero. On the other hand, if the attraction is weak, the liquid drop will form a tall spherical cap with a large contact angle and a small drop base area. In other words, the attraction between the liquid and the solid, the larger will be the contact angle, and the smaller will be the wetted area constituting the drop base. The interfacial attraction is directly related to the magnitude of the contact angle. This is further explained experimentally and theoretically below.

Return to FIGS. 14, 15, 16 and 17, which illustrate the experimental observation of a water drop 130 placed on a specimen of Teflon® PTFE 131 (contact angle 109°), Tefzel® ETFE 132 (contact angle=96°), nylon 133 (contact angle=80°), and styrene-butadiene rubber 134 (contact angle=63°), respectively. The contact angle is essentially independent of the drop volume. However, the drop height and the drop-base area are, of course, dependent on the drop volume. For ease of visualization and comparison, therefore, the volume of the water drop on each of the four different polymer surfaces is kept the same as illustrated in the figures.

The attraction between the water and the polymer surface decreases in the order: styrene-butadiene rubber 134 (strongest)>nylon 133>Tefzel® ETFE 132>Teflon® PTFE 131 (weakest). Therefore, the conact angle increases in the order: styrene-butadiene rubber 134 (smallest, contact angle=63°)<nylon 133 (contact angle=80°)<Tefzel® ETFE 132 (contact angle=96°)<Teflon® PTFE 131 (largest, contact angle 109°). The drop height increases in the order: styrene-butadiene rubber 134 (lowest)<nylon 133<Tefzel® ETFE 132<Teflon® PTFE 131 (tallest), whereas the drop base radius and area decreases in the order: styrene-butadiene rubber 134 (largest)>nylon>Tefzel® ETFE 132>Teflon® PTFE 131 (smallest).

The surface force which drives a liquid to enter a capillary pore and rise in it is the adhesion tension A, given by $$A=\gamma_{LV}\cos\theta_o \tag{3}$$

It can be seen then that the adhesion tension is "attractive" when the contact angle is below 90°, and has the greatest value when the contact angle is zero (i.e., $A=\gamma_{LV}$, when $\theta_o=0°$). It decreases to zero and becomes "neutral," when the contact angle is 90° (i.e., A=0, when $\theta_o=90°$). It is "repulsive" when the contact angle is above 90°, and has the lowest value when the contact angle is 180° (i.e., $A=-\gamma_{LV}$, when $\theta_o=180°$).

Figure 20:
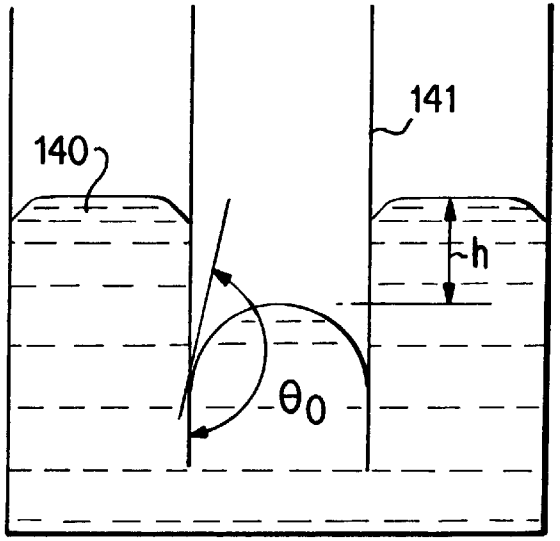
FIG. 20 illustrates that a liquid retracts in a capillary tube below the general planar surface of the liquid, when the contact angle is larger than 90°. In this case, the adhesion tension is negative and repulsive.
Figure 19:
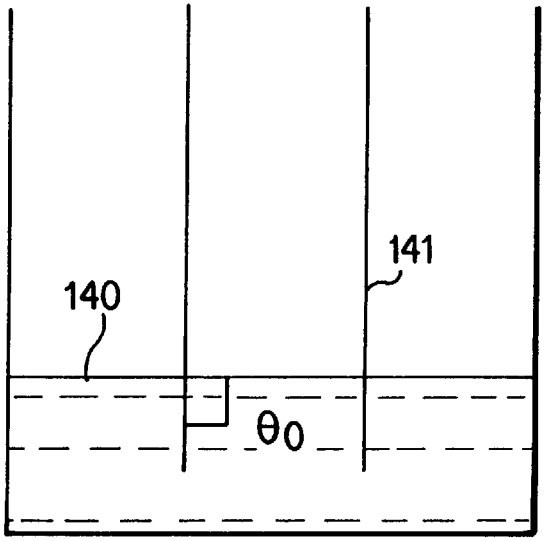
FIG. 19 illustrates that a liquid neither rises above nor retracts below the general planar surface of the liquid in a capillary tube, when the contact angle is equal to 90°. In this case, the adhesion tension is zero and neutral.
Figure 18:
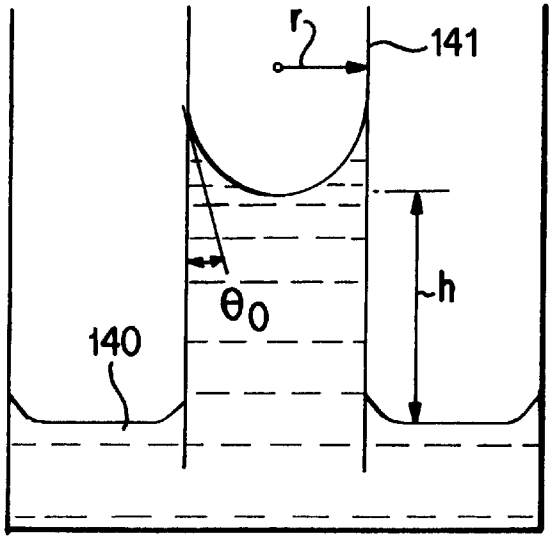
FIG. 18 illustrates that a liquid rises in a capillary tube above the general planar surface of the liquid, when the contact angle is smaller than 90°. In this case, the adhesion tension is positive and attractive.

This is illustrated by the movement of a liquid in a capillary tube. FIG. 18 shows that a liquid 140 will rise in a capillary pore 141 when the contact angle is smaller than 90°, since the adhesion tension is positive and attractive. FIG. 19 shows that a liquid 140 will not rise in a capillary pore 141 when the contact angle is 90°, since the adhesion tension is zero and neutral. FIG. 20 shows that a liquid 140 will retract in a capillary pore 141 when the contact angle is greater than 90°, since the adhesion tension is negative and repulsive. For practical purposes, it is thus commonly said and understood that a liquid does not wet a surface when the contact angle is greater than 90°.

The surface force F which acts around the circumference of the liquid meniscus to pull (or push) the liquid up (or down) a vertical cylindrical capillary pore is equal to the circumference of the meniscus ($2\pi r$) times the adhesion tension (A), i.e., $$F=2\pi rA \tag{4}$$

where r is the radius of the cylindrical capillary pore. The weight W of the liquid which rises (or retracts) in the capillary pore is given by $$W=\Delta\rho g\,\pi r^2 h \tag{5}$$

where $\Delta\rho$ is the difference in the densities of the liquid and the surrounding gas, g the gravitational acceleration, and h the height of the liquid column in the capillary pore above (or below) the general plane surface of the liquid.

The weight W of this liquid column is sustained by the surface force F, i.e., $$F=W \tag{6}$$

Substituting Equations (3), (4) and (5) in Equation (6) gives $$h=(2\gamma_{LV}/\Delta\rho gr)\cos\theta_o \tag{7}$$

Thus, it can be seen that when the contact angle is less than 90°, the liquid will rise up a capillary pore (since cos θ is positive, and so is h), and when the contact angle is larger than 90°, the liquid will be depressed down a capillary pore (since cos θ is negative, and so is h). On the other hand, when the contact angle is 90°, the liquid will not rise nor retract in a capillary pore (since cos θ is zero, and so is h). On the other hand, when the contact angle is 90°, the liquid will not rise nor retract in a capillary pore (since cos θ is zero, and so is h).

Therefore, it can be readily understood that an anticlogging surface is one on which the water exhibits an equilibrium contact angle $\theta_o$ equal to or greater than 90°, i.e., $$\theta_o \geqq 90° \tag{8}$$

This has been found to be generally consistent with the contact angle data and the expected anticlogging performance for polymers shown in Table V.

Variables Affecting the Contact Angle

The contact angle is a thermodynamic quantity, but can have many different values at a given temperature for a given liquid on a solid of a given chemical composition, determined by surface roughness, surface compositional heterogeneity, rate of motion, and a host of other factors such as adsorption, desorption, dissolution, and other physical and chemical processes which may occur when the liquid contacts the solid. Many of these factors are discussed, e.g., in books by S. Wu, *Polymer Interface and Adhesion*, Marcel Dekker, New York, 1982, and by J. J. Bikerman, *Surface Chemistry for Industrial Research*, Academic Press, New York, 1948, the disclosures of which are incorporated herein by reference. Therefore, it is necessary to clearly define the controlled laboratory conditions and methodology being used to determine the scope of the present invention.

For a given liquid on a solid of a given chemical composition at a given temperature, the three main factors affecting the measured contact angle are the rate of motion, surface roughness, and surface compositional heterogeneity.

When the liquid is at rest, the angle observed is the static contact angle. When the liquid is in motion relative to the solid, the angle observed is the dynamic contact angle. The contact angle varies with the rate of motion in complicated fashion, as discussed in Chapter 7 of the book by S. Wu, *Polymer Interface and Adhesion*. At sufficiently slow rates, however, the dynamic contact angle is independent of the rate and is equal to the static value.

When the contact angle is formed by advancing the liquid on the solid surface, the measured angle is called the advancing contact angle $\theta_a$. When the contact angle is formed by receding the liquid on the solid surface, the measured angle is called the receding contact angle $\theta_r$.

Any of the static and dynamic methods discussed in the reference books cited above can be used to measure the static and dynamic contact angles. These include sessile drop method, captive bubble method, tensiometric method, Wilhelmy plate method (or, vertical plate method), tilted plate method, capillary rise method, and others. The difference between the advancing and the receding contact angles is known as the contact angle hysteresis.

The experimental value of contact angle for a given liquid on a given specimen is usually reproducible within ±5°, although some investigators have reported a reproducibility of better than ±1° in some cases.

On an ideally smooth and compositionally homogenous surface, there is one and only one static contact angle, which is the equilibrium (or intrinsic) contact angle. This corresponds to the minimum free energy state for the system at rest, and there is no hysteresis, i.e., the advancing and the receding contact angles are the same.

However, many practical surfaces have various degrees of roughness and compositional heterogeneity. On such surfaces, the contact angle can have one stable and many metastable values.

The hysteresis due to surface roughness arises from energy barriers created by geometric factors, and is not an intrinsic property of the material. Therefore, for the present purpose, this effect and possible variations must be controlled or minimized in the contact angle measurement.

The equilibrium contact angle on a compositionally homogeneous but rough surface corresponds to the lowest free energy state for the system. This equilibrium contact angle is called the Wenzel's angle $\theta_w$. The Wenzel's angle is related to the true equilibrium contact angle (i.e., the intrinsic contact angle $\theta_o$) on an ideally smooth surface of the same composition by $$\cos\theta_w = r\cos\theta_o \quad (9).$$

The parameter r is the roughness factor, defined by $$r = A/A' \quad (10)$$

where A is the true surface area (taking into account the peaks and valleys on the surface), and A' is the planar geometric area. Since r is equal to or greater than unity, i.e., $r \geqq 1$, the Wenzel's angle tends to be greater than the intrinsic contact angle when the latter is greater than 90°, but smaller than the intrinsic contact angle when the latter is smaller than 90°, and the same as the intrinsic contact angle when the latter is equal to 90°.

The surface of a shoe sole may be embossed to have certain geometrical or topographical patterns, or have certain roughnesses due to machine and mill marks and/or incomplete fusion, coalescence and leveling of the granules of the component materials. These surface patterns and roughnesses can cause contact angle hysteresis. Unusually, the hysteresis may be negligible, when the roughness is below 0.1°~0.5 $\mu$m. The maximum hysteresis due to roughness is $2\alpha_{max}$, where $\alpha_{max}$ is the maximum angle of inclination of the surface roughness (see Chapter 1 of the book by S. Wu, *Polymer Interface and Adhesion*. Therefore, on a polished smooth surface, the hysteresis is usually less than 5~10°. On optically smooth surfaces, any significant hysteresis tends to arise mainly from surface heterogeneity.

On the other hand, the hysteresis due to surface heterogeneity arises from energy barriers which exist at the phase boundaries, and is created by compositional factors. Therefore, it is an intrinsic property of a given composition. Of course, the surface must not be contaminated by foreign impurities.

The surface of a neat polymer should be compositionally homogenous. But, polymers containing additives, surface active agents, and other miscible or immiscible polymers tend to have heterogenous surfaces. The various components in the blend may not be molecularly and homogeneously mixed, but rather exist as a mixture of separate domains, i.e., having a compositionally heterogeneous surface. The phase boundaries between domains of different intrinsic contact angles present energy barriers, which cause contact angle hysteresis. The hysteresis due to surface heterogeneity is usually of the same order of magnitude as that due to surface roughness (i.e., 5°~10°), but can be as much as an order of magnitude greater in some cases.

The equilibrium contact angle of a heterogeneous but smooth surface is related to the intrinsic contact angles of the constituent domains by, $$\cos\theta_o = f_1\cos\theta_{o1} + f_2\cos\theta_{o2} \quad (11)$$

where $f_1$ and $f_2$ are the fractions of the surface covered by components 1 and 2 respectively, and $\theta_{o1}$ and $\theta_{o2}$ are the intrinsic contact angles of the components 1 and 2 respectively.

The advancing contact angle tends to reflect the region of higher intrinsic contact angle (or lower surface tension), and the receding contact angle tends to reflect the region of lower intrinsic contact angle (or higher surface tension), i.e., $$\theta_a \approx \theta_{o1} \quad (12)$$

and, $$\theta_r \approx \theta_{o2} \quad (13)$$

where $\theta_{o1}$ is the intrinsic contact angle of the region of lower surface tension, and $\theta_{o2}$ is the intrinsic contact angle of the region of higher surface tension. Thus, the equilibrium contact angle on a heterogeneous but smooth surface may be given approximately by $$\cos\theta_o \approx f_1\cos\theta_a + f_2\cos\theta_r \quad (14)$$

where region 1 has higher intrinsic contact angle (lower surface tension), and region 2 has lower intrinsic contact angle (higher surface tension).

The equilibrium contact angle corresponds to the stable equilibrium, wherein the system has the lowest free energy. In practice, however, this is seldom observed on a rough and/or heterogeneous surface. The system is more likely to reside in one of the numerous metastable states available to the system, and exhibits a contact angle hysteresis, i.e., the advancing and the receding contact angles are different. The exact metastable state on which the system resides is determined by the height of energy barriers on the solid surface and the vibrational energy of the liquid drop, among other factors.

The equilibrium contact angle lies somewhere between the advancing and the receding values, and can be approximated by the average of the advancing and receding contact angles, i.e., $$\theta_o \approx (1/2)(\theta_a + \theta_r) \quad (15)$$

regardless of the origin of the hysteresis, i.e., whether the hysteresis is due to surface roughness, compositional heterogeneity, or combined effects thereof. When there is no hysteresis, the advancing and the receding contact angles are identical to the equilibrium contact angel, i.e., $$\theta_o=\theta_a=\theta_r \quad (16)$$

and the observed angle is the equilibrium contact angle.

The contact angle also varies with the temperature, although this dependency is usually quite small except near the boiling point of the liquid, as discussed in Chapter 4 of the book by S. Wu, *Polymer Interface and Adhesion*. For the present purpose of defining the scope of the present invention, all contact angles are to be measured at 20°~30° C.

Furthermore, during physical activities, the shoe sole repeatedly contacts and separates from the playing surface, and the mud can repeatedly stick to and release from the shoe sole. The advancing contact angle relates to the extent to which the mud will stick to a shoe sole, while the receding contact angle relates to the ease of retraction or release of the mud from the shoe sole. Therefore, a certain average value of the advancing and the receding contact angles should also be expected to relate to the overall anticlogging performance of the shoe sole through such dynamic mechanism.

Since the contact angles are preferably to be measured on sufficiently smooth or preferably specularly smooth surfaces, the hysteresis due to surface roughness may be minimized to within 5°~10°. The main source of hysteresis under these controlled conditions would thus be substantially due to surface heterogeneity.

In accordance with the above discussion, and for the purpose of defining the scope of the present invention, the contact angle shall be measured as follows. First, pure distilled water shall be used as the liquid. Second, the contact angle used shall be the static contact angle. The rate of motion shall be sufficiently slow such that, within experimental error, the dynamic contact angle is independent of the rate of motion and is equal to the static contact angle. Third, both the advancing and the receding contact angles shall be measured. Fourth, the temperature of measurement shall be between 20°~30° C. Fifth, the surface of the solid specimen shall be sufficiently smooth such that the contact angle hysteresis due to surface roughness is less than 10°, and preferably specularly smooth such that the contact angle hysteresis due to surface roughness is less than 5°. Sixth, the surface of the specimen shall be free from contamination by foreign matter.

Although the contact angle is subject to many intrinsic and extrinsic variables as discussed herein, the equilibrium contact angle can usually be measured within an uncertainty of ±5°, when the proper protocol is followed in the measurement. This is illustrated in Table V. It shows that the values of equilibrium contact angle on the surface of a given chemical composition measured by different investigators, using specimens prepared in different laboratories with materials obtained from different sources usually have a standard deviation of less than 5°.

In the preferred embodiments, given the controlled laboratory conditions, protocol and methodology described herein, preferred anticlogging shoe sole materials are those which exhibit an equilibrium contact angle $\theta_o$ equal to or greater than 90°, i.e., $$\theta_o \geqq 90° \quad (17)$$

In a practical system, however, the equilibrium contact angle is seldom observed. Instead, the system will show contact angle hysteresis due to surface roughness and/or surface compositional heterogeneity. The equilibrium contact angle is approximated by the average of the advancing and the receding contact angles, as given in Equation 15. Herein we define this average value as the wettability index, i.e., $$WI=(½)\ (\theta_a+\theta_r) \quad (18)$$

where WI stands for wettability index.

Therefore, in the preferred embodiments, the preferred anticlogging shoe sole materials are those that, given the controlled laboratory conditions, protocol and methodology described herein, exhibit a wettability index of equal or greater than about 90°, i.e., $$WI=(½)\ (\theta_a+\theta_r) \geqq 90° \quad (19)$$

The wettability index tends to under-emphasize the advancing contact angle and over-emphasize the receding contact angle, and thus under-estimate the equilibrium contact angle. Therefore, the approximate condition defined in terms of the wettability index by Equation 19 is more "conservative" than the fundamental condition defined by Equation 17.

In other words, if a material meets the condition given by Equation 19, it should also meet the fundamental condition given by Equation 17. But, some materials which do not meet the condition specified by Equation 19 could still meet the fundamental condition specified by Equation 17.

Table V lists the contact angles of water at 20°~30° C. on a number of polymer surfaces. The data show variations among different investigators. These variations are apparently due to the differences in sample preparation, purity, contamination, experimental method, and/or hystereses due to roughness and heterogeneity. Notice however that the standard deviations of the values reported by different investigators are usually within 5°.

TABLE V

Contact Angles of Water on Some Polymer Surfaces at 20~30° C.

| $\theta_o$ or $\theta_a$ degree | $\theta_r$ degeee | Wettability Index $(½)(\theta_o + \theta_r)$ degree | Reference |
|---|---|---|---|
| Polytetrafluoroethylene (PTFE) | | | |
| 108 | — | — | Fox & Zisman (1950) |
| 109 | — | — | Watanabe et al (1988) |
| 111.0 | — | — | Janczuk & Bialopiotrowicz (1989) |
| 116 | — | — | Busscher et al (1983) |
| 106~112 | — | — | El-Shimi & Goddard (1974) |
| 112 | — | — | Dann (1970) |

TABLE V-continued

Contact Angles of Water on Some Polymer Surfaces at 20~30° C.

| $\theta_o$ or $\theta_a$ degree | $\theta_r$ degeee | Wettability Index $(½)(\theta_o + \theta_r)$ degree | Reference |
|---|---|---|---|
| 112.3 | — | — | Penn & Miller (1980) |
| 109 | 106 | 107.5 | Petke & Ray (1969) |
| — | 86~97 (*) | — | Lyden (This work) |
| 110.8 ± 2.9 (Average value of all data cited in the first column) | | | |
| Polyhexafluoropropylene (PHFP) | | | |
| 113 | — | — | Bernett & Zisman (1961) |
| Polytrifluoroethylene | | | |
| 92 | — | — | Ellison & Zisman (1954) |
| Poly(tetrafluoroethylene-co-chlorotrifluoroethylene), TFE/CTFE 80/20 by weight | | | |
| 100 | — | — | Fox & Zisman (1952) |
| Poly(tetrafluoroetylene-co-chlorotrifluoroethylene), TFE/CTFE 60/40 by weight | | | |
| 94 | — | — | Fox & Zisman (1952) |
| Polychlorotrifluoroethylene (PCTFE) | | | |
| 90 | — | — | Fox & Zisman (1952) |
| Poly(ethylene-co-tetrafluoroethylene), ETFE 50/50 by mole | | | |
| 93 | — | — | Fox & Zisman (1952) |
| 96 | — | — | Lyden (This work) |
| Poly(vinyl fluoride), PVF | | | |
| 80 | — | — | Ellison & Zisman (1954) |
| Poly(vinylidene fluoride), PVDF | | | |
| 82 | — | — | Ellison & Zisman (1954) |
| Polyhexafluoropropylene (PHFP) | | | |
| Poly(vinyl chloride), PVC | | | |
| 87 | — | — | Ellison & Zisman (1954) |
| 83 | — | — | Dann (1970) |
| Poly(vinylidene chloride), PVDC | | | |
| 80 | — | — | Ellison & Zisman (1954) |
| Polyethylene (PE) | | | |
| 94 | — | — | Fox & Zisman (1952) |
| 94 | — | — | Watanabe et al (1988) |
| 104 | — | — | Owens & Wendt (1969) |
| 102 | — | — | Wu (1982) |
| 96.1 | — | — | Janczak & Bialopiotrowicz (1989) |
| 95 | — | — | El-Shimi & Goddard (1974) |
| 93.9 | — | — | Fowkes et al (1980) |
| 95 | — | — | Dann (1970) |
| 103 | — | — | Busscher et al (1984) |
| 95 | — | — | Van de Valk et al (1983) |
| 101 | — | — | Fort (1964) |
| 96 | 62 | 79 | Petke & Ray (1969) |
| 97.4 ± 3.9 (Average value of all data cited in the first column) | | | |
| Paraffin Wax | | | |
| 108 | — | — | Fox & Zisman (1952) |
| 110.6 | — | — | Janczuk & Bialopiotrowicz (1989) |
| 108~110 | — | — | El-Shimi & Goddard (1974) |
| 106 | — | — | Panzer (1973) |
| 110 | — | — | Dann (1970) |
| 108~111 | — | — | Fox & Zisman (1951) |
| 105 | — | — | Elton (1951) |
| 110~111 | — | — | Fox & Zisman (1950) |
| 108.9 ± 2.0 (Average value of all data cited in the first column) | | | |
| Polystyrene (PS) | | | |
| 91 | — | — | Ellison & Zisman (1954) |
| 84 | — | — | Dann (1970) |

TABLE V-continued

Contact Angles of Water on Some Polymer Surfaces at 20~30° C.

| $\theta_o$ or $\theta_a$ degree | $\theta_r$ degeee | Wettability Index $(½)(\theta_o + \theta_r)$ degree | Reference |
|---|---|---|---|
| 91 | 84 | 87.5 | Petke & Ray (1969) |
| 88.7 ± 4.0 (Average value of all data cited in the first column) | | | |
| Nylon I | 80 (*) | — | Lyden (This work) |
| Nylon II | 66 (*) | — | Lyden (This work) |
| Nylon III | 51 (*) | — | Lyden (This work) |
| Nylon 6 | | | |
| 70 | — | — | Fort (1964)] |
| Nylon 66 | | | |
| 70 | — | — | Ellison & Zisman (1954) |
| 72 | — | — | Owens & Wendt (1969) |
| 65 | — | — | Dann (1970) |
| 73 | — | — | Fort (1964) |
| 70.0 ± 3.6 (Average value of all data cited in the first column) | | | |
| Nylon 77 | | | |
| 70 | — | — | Fort (1964) |
| Nylon 88 | | | |
| 86 | — | — | Fort (1964) |
| Nylon 99 | | | |
| 82 | — | — | Fort (1964) |
| Nylon 1010 | | | |
| 94 | — | — | Fort (1964) |
| Poly(ethylene terephthalate) (PET) | | | |
| 81 | — | — | Ellison & Zisman (1954) |
| 76 | — | — | Owens & Wendt (1969) |
| 76.5 | — | — | Janczuk & Bialopiotrowicz (1989) |
| 71 | — | — | Dann (1970) |
| 82 | 55 | 68 | Petke & Ray (1969) |
| 77.3 ± 4.4 (Average value of all data cited in the first column) | | | |
| Poly(methyl methacrylate), PMMA | | | |
| 80 | — | — | Jarvis et al (1964) |
| 73.8 | — | — | Janczuk & Bialopiotrowicz (1989) |
| 74 | — | — | El-Shimi & Goddard (1974) |
| 71 | — | — | Panzer (1973) |
| 74 | — | — | Dann (1970) |
| 76 | — | — | Busscher et al (1984) |
| 85 | — | — | Fox & Zisman (1952) |
| 80 | — | — | Van der Valk et al (1983) |
| 78 | — | — | Craig et al, (1960) |
| 71 | — | — | Toyama & Ito (1974) |
| 76 | — | — | Petke & Ray (1969) |
| 76.3 ± 4.2 (Average value of all data cited in tke first column) | | | |
| Polycarbonate (PC) | | | |
| 84 | 68 | 76 | Petke & Ray (1969) |
| Polyoxymethylene (POM) | | | |
| 79 | 54 | 66.5 | Petke & Ray (1969) |
| DRC Rubber Compound | 77 (*) | — | Lyden (This work) |
| Nitrile Rubber | 75 (*) | — | Lyden (This work) |
| BRS 1000 (SB Rubber) | 63 (*) | — | Lyden (This work) |

Note (*) Measured with tap water, so the contact angle may be about 5 degrees lower than with distilled water, explained below.

The "impurities" in the tap water tend to lower the contact angle by lowering both the surface tension and the surface polarity of the tap water. Theoretical computation indicates that these two effects have similar magnitudes. The combined effects tend to cause the contact angle of a tap water to be lower than that of the pure distilled water by about 2 to 10 degrees, depending on the nature of the polymer and the tap water used. Therefore, as a rule of thumb, a "typical" municipal tap water is estimated to exhibit a contact angle about 5 degrees lower than that of the pure distilled water.

Methods of Making the Preferred Embodiments

Many methods of making ground engaging surface 60 or traction member 40 using a suitable adhesion prevention material 65 having a low coefficient of friction and low wettability are possible. For example, the desired component can be made in whole or part using a desired plastic adhesion prevention material 65 by extrusion or molding, e.g., compression, injection, transfer, rotational, or blow molding. Alternatively, adhesion prevention material 65 can be applied to a component of an article of footwear 10 by being stock-fitted or affixed using adhesives. An adhesion prevention material 65 can be affixed using chemical bonding, as discussed in co-pending applications Ser. No. 08/442,355, entitled "Chemical Bonding of Rubber to Plastic In Articles of Footwear," which is a continuation of application Ser. No. 07/986,046 filed Dec. 10, 1992 and now abandoned, and Ser. No. 08/279,858, entitled "Method for Chemical Bonding of Rubber to Plastic in Articles of Footwear," both co-pending applications being hereby incorporated by reference. Adhesion prevention material 65 can also be applied by dipping, spin-coating, spraying, or any other suitable method of application.

A suitable method for affixing a skived thin sheet or film of a suitable plastic adhesion prevention material 65, e.g., a fluoropolymer such as Teflon® polytetrafluoroethylene, to a member of an article of footwear 10 includes having the surface to be adhered chemically etched using, e.g., sodium naphthalene or sodium ammonia. Sodium naphthalene etching can be accomplished, e.g., using the "Tetra-Etch" process by W. L. Gore & Associates of Phoenix, Ariz., and sodium ammonia etching can be done, e.g., by the Porter Chemical Company of Hatfield, Pa. Etched Teflon® PTFE film has a shelf life of approximately six months before suffering undo degradation due to exposure to ultraviolet radiation. A suitable primer or adhesive is then applied to the etched surface of the plastic adhesion prevention material 65. For example, Chemlok® 252X adhesive made by the Lord Corporation of Erie, Pa., is particularly suitable for affixing etched Teflon® PTFE film to nitrile based rubber compositions. Chemlok® 487 adhesive is suitable for affixing etched Teflon® PTFE film to nylon or polyamide. Chemlok® 213 adhesive is suitable for affixing etched Teflon® PTFE film to urethane rubber. Prescriptions for adhesives suitable for affixing other materials can be found in technical materials provided by the Lord Corporation attached to the present application, and incorporated by reference herein.

The skived sheet or film of a suitable plastic adhesion prevention material 65 is manually cut or die cut to a desired shape and placed into a compression mold such that the etched and primed surface will be exposed to the other material(s) which will be introduced therein and be subject to compression molding. The material selected for compression molding, e.g., a styrene butadiene or nitrile based rubber based rubber compound, is then introduced into the mold and the mold is closed, subjected to appropriate levels of heat and pressure for an optimal duration to effect setting or curing of the material to the desired shape and physical and mechanical properties including the approximate specific gravity. The mold is then removed, opened, and the part removed.

In addition, it can be advantageous to utilize a three part mold 90 having two cavities 95 and 100, as shown in FIG. 8. The upper cavity 95 can be used to form the adhesion prevention material 65 to a desired three-dimensional shape using heat and pressure. This piece is then inserted into the lower cavity 100 with a second material 105 to be compression molded while at an elevated temperature and the molded finished part is made, as the next piece of plastic non-stick material 65 is inserted into the upper cavity 31 and formed to the desired three-dimensional shape.

EXAMPLE 1

The above method was used to affix a skived sheet of Teflon® PTFE having a thickness between 15 to 20 mils which had been etched with sodium ammonia, primed with Chemlok® 252X adhesive and formed to a desired three dimensional shape in a mold for a soccer outsole. The piece of Teflon® PTFE was cut to a desired shape and included holes for accommodating the tips 45 of the would-be cleats or traction members 40. The Teflon® PTFE piece was then paced in the mold, a nitrile based rubber compound was then inserted and the mold was closed. The mold was pressed with approximately 100 tons using a 200 ton press and subjected to 320° F. for a duration of seven minutes to effect cure of the rubber composition and bonding to the Teflon® PTFE. The bond strength effected was greater than 4.2–4.5 kg/cm.

Another method comprises forming a ground engaging surface 60 of an article of footwear 10 including a suitable adhesion prevention material 65, then affixing thereto tips 45 of cleats or traction members 40. This can be accomplished by using conventional mechanical attachment means, or with the use of adhesives, welding, or bonding. One possible representation of outsole 20 produced using this method is shown in FIG. 7.

When a surfactant is being used to modify the surface characteristics of a parent polymer, natural or synthetic rubber, generally, a ratio of less than 5% and often even less than 1% with respect to the parent material is sufficient to provide desired physical properties. Some surfactants can be relatively mobile within the parent material and can bloom to the surface. Even when the surface of the adhesion preventing material used on the outsole is abraded and removed, the surfactant contained therein can then renew itself upon the surface. However, the blooming action of a surfactant could also possibly lead to a delamination, or failure of the adhesive bond between the outsole and midsole or shoe upper.

Figure 13:
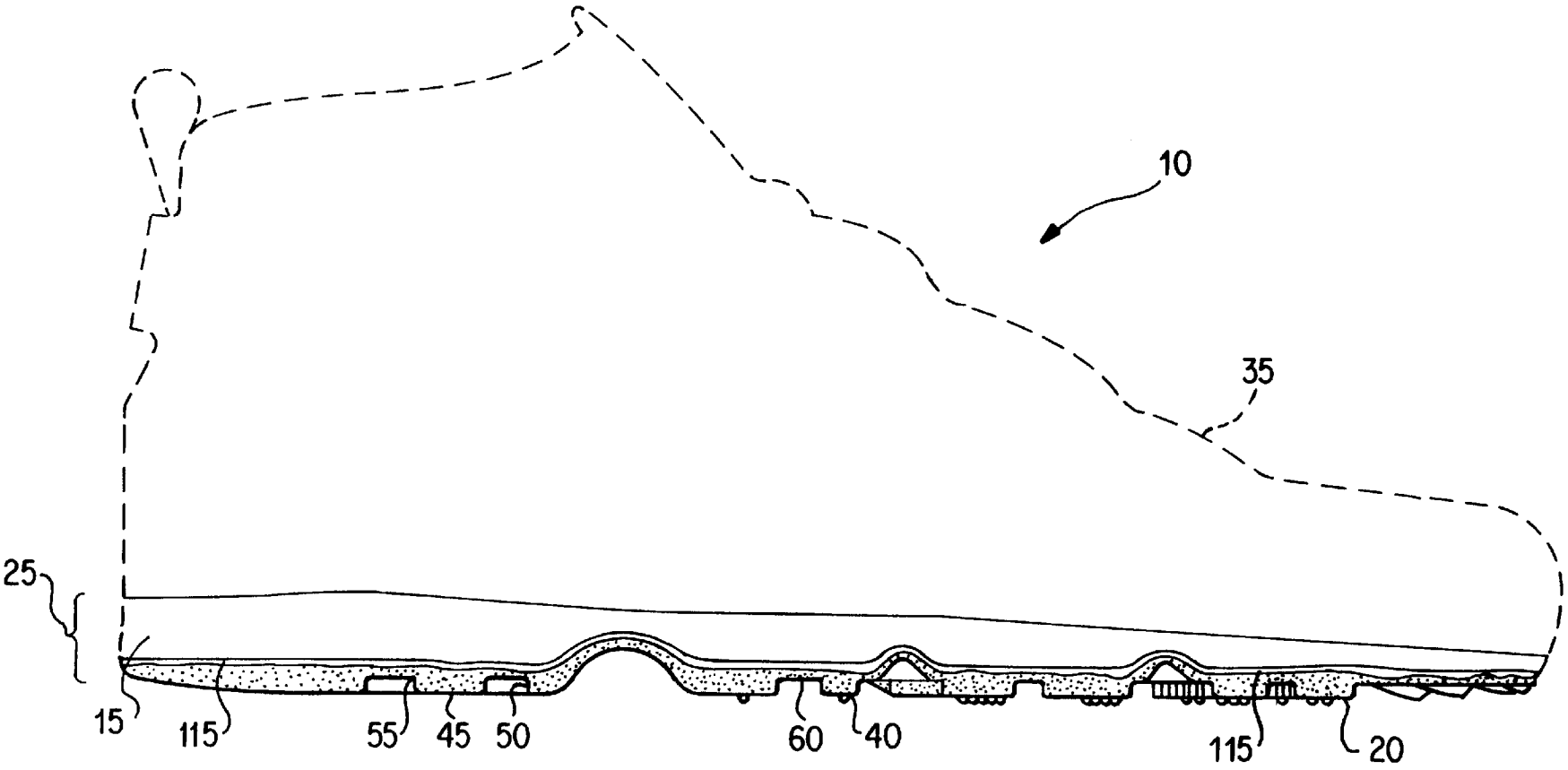
FIG. 13 is a cross-section view illustrating the use of an intermediate material between an adhesion prevention material used on the sole and the shoe upper of an article of footwear.
Figure 14:
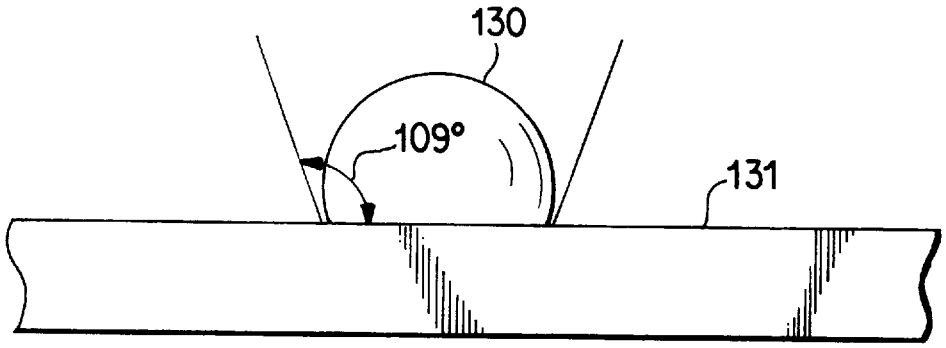
FIG. 14 is a drawing of a water drop placed on a specimen of polytetrafluoroethylene PTFE illustrating a contact angle of 109°.
Figure 15:
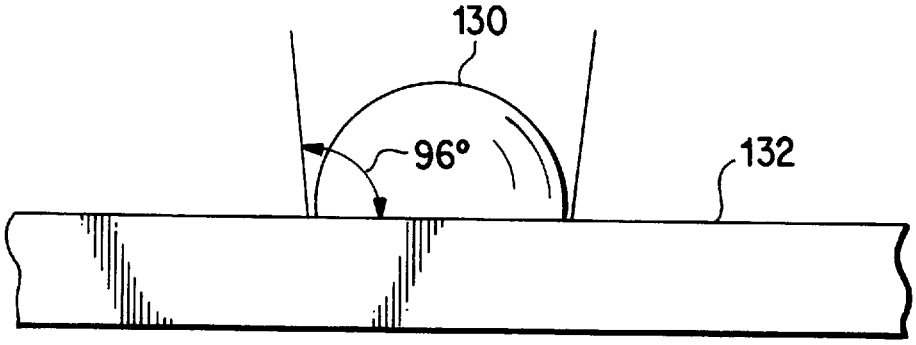
FIG. 15 is a drawing of a water drop placed on a specimen of Tefzel® ETFE illustrating a contact angle of 96°.
Figure 16:
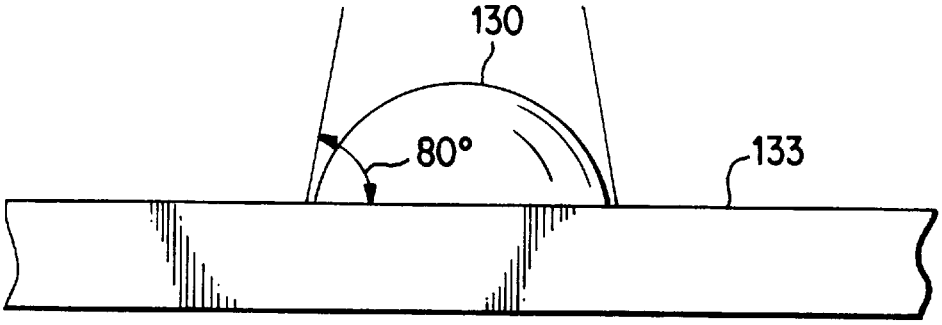
FIG. 16 is a drawing of a water drop placed on a specimen of nylon illustrating a contact angle of 80°.
Figure 17:
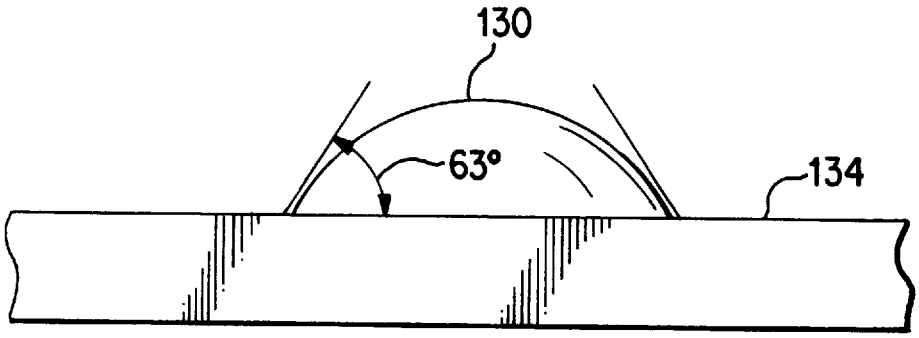
FIG. 17 is a drawing of a water drop placed on a specimen of styrene-butadiene rubber illustrating a contact angle of 63°.

For this reason, it can be advantageous to affix that portion of the outsole 20 including the adhesion prevention material 65 to an intermediate material 115 which serves as a barrier with regards to the possible migration of the surfactant. This intermediate material 115 could be a natural or synthetic textile, a plastic material, e.g., polyurethane film, or Pebax®, a polyamide made by Elf AtoChem of Paris, France, a natural or synthetic rubber, a metal, a composite material, or other useful material not including the surfactant. Regardless of whether a potential migration problem is present with regards to the adhesion prevention material 65, it can sometimes be advantageous to use an intermediate material 115 for facilitating bonding and the construction of an article of footwear 10. The adhesion prevention material 65 can be affixed to the intermediate material 115 with the use of conventional primers and adhesives, by mechanical bonding, by chemical bonding or chemical grafting, or by a co-extrusion, injection, or compression molding of the materials. The opposite surface of the intermediate material 115 can then be bonded, e.g., by conventional means, to the shoe upper 35 or other component of an article of footwear 10, as shown in FIG. 13.

When a fluoroelastomer such as Aflas® material is used as the adhesion prevention material, it is possible to use primers, e.g., as made by the Lord Corporation, with conventional adhesives to bond the fluoroelastomer adhesion prevention material to a second material used in the shoe sole, or to the shoe upper. It can also be advantageous to affix the fluoroelastomer to an intermediate material, as described above. However, in some cases it is also possible to directly covulcanize the fluoroelastomer segment of the outsole to a second more convention outsole material, e.g., natural or synthetic rubbers such as nitrile rubber or styrene-butadiene rubber. This second outsole material can then in turn be bonded on its opposite surface by conventional means such as with the use of conventional adhesives to the shoe upper.

A preferred method of making the present invention includes the use of a melt-processable fluoropolymer such as Tefzel® ETFE as the adhesion preventing material to be used on the ground engaging surface of the shoe sole in combination with another conventional sole material when making the shoe sole component in an injection or compression molding process. Tefzel® ETPE is an alternating copolymer of ethylene and tetrafluoroethylene, which may also contain a small amount of a third perfluorinated comonomer. It is melt-processable, has low wettability, good non-stick performance and good chemical resistance. Furthermore, its hardness can be modified with mineral fillers, as desired.

Although the present invention has been illustrated in terms of preferred embodiments, it will be obvious to one of ordinary skill in the art that numerous modifications may be made without departing from the scope of the invention which is to be limited only by the appended claims.

What is claimed is:

1. An article of footwear comprising:

an upper for accommodating and securing said article of footwear to a wearer's foot;

a sole attached to said upper, said sole including a generally planar ground engaging surface and at least two traction members projecting from said generally planar ground engaging surface, each of said at least two traction members including a base surface adjacent said generally planar ground engaging surface, side surfaces, and a tip;

wherein at least a portion of said base surface and said side surfaces of each of said at least two traction members and at least a portion of said generally planar ground engaging surface between said at least two traction members are integrally molded and comprise an adhesion prevention material having both a low coefficient of friction and a low wettability with regard to water; and wherein said tip of each of said at least two traction members remains substantially free of said adhesion prevention material.

2. The article of footwear according to claim 1, wherein said adhesion prevention material has a wettability index equal to or greater than about 90 degrees.

3. The article of footwear according to claim 1, wherein said adhesion prevention material has a wettability index equal to or greater than about 100 degrees.

4. The article of footwear according to claim 1, wherein said adhesion prevention material has a coefficient of friction of less than about 0.4.

5. The article of footwear according to claim 2 wherein said adhesion prevention material has a coefficient of friction between about 0.1 and 0.3.

6. The article of footwear according to claim 1, wherein said tip is removably attached to a lower end of each of said at least two traction members.

7. The article of footwear according to claim 1, wherein at least a portion of said ground engaging surface is formed from a material selected from the group consisting of natural and synthetic rubbers, styrene butadiene rubber, nitrile rubber, carbon black rubber, urethane rubber, polyurethane, ethylene vinyl acetate copolymer, and polyamide.

8. The article of footwear according to claim 1, wherein said adhesion prevention material is selected from the group consisting of silicones and fluorosilicones.

9. The article of footwear according to claim 1, wherein said adhesion prevention material comprises a fluoropolymer.

10. The article of footwear according to claim 9, wherein said fluoropolymer is polytetrafluoroethylene.

11. The article of footwear according to claim 9, wherein said fluoropolymer is poly-(ethylene-co-tetrafluroethylene).

12. The article of footwear according to claim 1, wherein at least a portion of said ground engaging surface is a foam material.

13. The article of footwear according to claim 12, wherein said foam material is a material selected from the group consisting of urethane rubber, polyurethane, polyethylene, and ethylene vinyl acetate open and closed cell foams.

14. The article of footwear according to claim 1, wherein said adhesion prevention material comprises a blended polymer.

15. The article of footwear according to claim 1, wherein said adhesion prevention material comprises a surface active additive.

16. The article of footwear according to claim 1, wherein said adhesion prevention material comprises a fiber.

17. The article of footwear according to claim 1, wherein said adhesion prevention material comprises a textile.

18. The article of footwear according to claim 1, wherein said adhesion prevention material comprises a metal matrix composite.

19. The article of footwear according to claim 1, wherein said adhesion prevention material comprises a graphite composite.

20. The article of footwear according to claim 1, wherein said adhesion prevention material comprises a filler material.

21. The article of footwear according to claim 1, wherein each of said at least two traction members is a lug.

22. The article of footwear according to claim 1, wherein said side surfaces of each of said at least two traction members project at an angle of approximately ninety degrees from said ground engaging surface of said sole.

23. The article of footwear according to claim 1, wherein said side surfaces of each of said at least two traction members are tapered and project at an angle greater than ninety degrees from said ground engaging surface of said sole.

24. The article of footwear according to claim 1, wherein said side surfaces of each of said at least two traction members are curvilinear.

25. The article of footwear according to claim 24, wherein said sole includes an adhesion prevention insert integrally formed with said sole and positioned in the area proximate said base of at least one of said traction members.

26. The article of footwear according to claim 1, wherein said base of each of said at least two traction members is substantially comprised of said adhesion prevention material.

27. The article of footwear according to claim 1, wherein said adhesion prevention material comprises a thin skived film laminate surface.

28. The article of footwear according to claim 1, wherein said adhesion prevention material comprises a permanently affixed thin dip coated surface.

29. The article of footwear according to claim 1, wherein said adhesion prevention material comprises a permanently affixed thin sprayed surface.

30. The article of footwear according to claim 1, wherein said adhesion prevention material is affixed to an intermediate material for facilitating the bonding of at least a portion of said sole to another component of said article of footwear.

31. The article of footwear according to claim 30, wherein said intermediate material comprises a polyamide.

32. The article of footwear according to claim 30, wherein said intermediate material comprises a polyurethane material.

33. The article of footwear according to claim 30, wherein said intermediate material comprises a textile.

34. An article of footwear comprising:

an upper for accommodating and securing said article of footwear to a wearer's foot;

a sole attached to said upper, said sole including a generally planar ground engaging surface and at least two traction members projecting from said generally planar ground engaging surface, said traction members each including a base surface adjacent said generally planar ground engaging surface, side surfaces, and a tip;

wherein at least a portion of said base surface and said side surfaces of each of said traction members and at least a portion of said generally planar ground engaging surface between said at least two traction members comprises an adhesion prevention material having both a low coefficient of friction and a low wettability with regard to water; and wherein said tip of said traction member is formed as an integral portion of the sole and is substantially free of said adhesion prevention material.

* * * * *